US012453877B2

(12) United States Patent
Su

(10) Patent No.: US 12,453,877 B2
(45) Date of Patent: Oct. 28, 2025

(54) FOLDABLE HORIZONTAL BARS

(71) Applicant: Yinglin Han, Shandong (CN)

(72) Inventor: Qingyong Su, Qingdao (CN)

(73) Assignee: Yinglin Han, Qingdao (CN)

( * ) Notice: Subject to any disclaimer, the term of this patent is extended or adjusted under 35 U.S.C. 154(b) by 223 days.

(21) Appl. No.: 18/167,898

(22) Filed: Feb. 13, 2023

(65) Prior Publication Data

US 2024/0269502 A1 Aug. 15, 2024

(51) Int. Cl.
*A63B 1/00* (2006.01)

(52) U.S. Cl.
CPC ..... *A63B 1/005* (2013.01); *A63B 2210/50* (2013.01)

(58) Field of Classification Search
CPC ..... A63B 23/1218; A63B 1/005; A63B 1/00; A63B 21/068; A63B 2225/09; A63B 2225/093; A63B 2210/50
See application file for complete search history.

(56) References Cited

U.S. PATENT DOCUMENTS 10,813,832 B2 * 10/2020 Qiu ..... A47F 5/103
D955,522 S * 6/2022 Song ..... D21/797
D971,367 S * 11/2022 Meng ..... D21/796
11,872,431 B1 * 1/2024 Liu ..... A63B 23/1218
11,896,863 B2 * 2/2024 Ivanov ..... A63B 69/34
2023/0141103 A1 * 5/2023 Christiansen ..... A61H 1/02 601/5
2024/0325819 A1 * 10/2024 Adams ..... A61H 3/00

FOREIGN PATENT DOCUMENTS

CN 201921376 U 8/2011
CN 208678243 U 4/2019
CN 210384680 U 4/2020
CN 216258887 U 4/2022

* cited by examiner

*Primary Examiner* — Andrew M Kobylarz
(74) *Attorney, Agent, or Firm* — METIS IP LLC

(57) ABSTRACT

The present disclosure provides a foldable horizontal bar. The foldable horizontal bar may include a horizontal bar; a pair of supports configured to support the horizontal bar; and a pair of bases. Each base may include a first movable part, a second movable part, and a fixed part. The fixed part may be mechanically connected with the first movable part and the second movable part. The first movable part may be rotatable around a first connection point between the fixed part and the first movable part within a preset angle. The second movable part may be rotatable around a second connection point between the fixed part and the second movable part within the preset angle. The preset angle being larger than 90 degrees.

19 Claims, 19 Drawing Sheets

FOLDABLE HORIZONTAL BARS

TECHNICAL FIELD

The present disclosure relates to the field of apparatus/assembly of training and exercise, in particular, to foldable horizontal bars.

BACKGROUND

At present, doing sports and physical exercise, especially at home, becomes more and more popular and important. As a common in-room sports supply, the horizontal bars are widely provided in a gym. More and more families are also equipped with the horizontal bars for doing at-home exercises. However, the horizontal bars usually have a large volume, a heavy weight, and a fixed height. Due to the above-mentioned limitations, the horizontal bars are not easy to be stored and/or moved, and not conducive for beginners to practice in a convenient way.

Therefore, it is desirable to provide a foldable horizontal bar, thereby improving the convenience for storage, movement, and adjustment of the horizontal bar, thus in turn improving the device's adaptability for different scenarios.

SUMMARY

As an aspect of the present disclosure, a foldable horizontal bar is provided. The foldable horizontal bar may include a horizontal bar, a pair of supports configured to support the horizontal bar; and a pair of bases. Each base may include a first movable part, a second movable part, and a fixed part. The fixed part may be mechanically connected with the first movable part and the second movable part. The first movable part may be rotatable around a first connection point between the fixed part and the first movable part within a preset angle. The second movable part may be rotatable around a second connection point between the fixed part and the second movable part within the preset angle. The preset angle may be larger than 90 degrees. The foldable horizontal bar may change between an unfolded state and a folded state when the first movable part and the second movable part rotate around the first connection point and the second connection point.

In some embodiments, the foldable horizontal bar may include a first length along an extension direction of the horizontal bar and a second length along an extension direction of the fixed part. When the foldable horizontal bar is in the unfolded state, a ratio of the first length to the second length may be substantially equal to 1:1.

In some embodiments, when the foldable horizontal bar is in the folded state, the ratio of the first length to the second length may be substantially equal to 4:1.

In some embodiments, the first movable part, the second movable part, and the fixed part may form a triangle shape when the foldable horizontal bar is in the folded state. A top angle of the triangle shape may be in a range from 60 degrees to 90 degrees.

In some embodiments, the first movable part and the second movable part may be foldable. When the first movable part and the second movable part are folded, the foldable horizontal bar may be in a partially-folded state, and the top angle of the triangle shape may be greater than 60 degrees and less than 90 degrees.

In some embodiments, an occupied area of the foldable horizontal bar in the folded state may be less than an occupied area of the foldable horizontal bar in the unfolded state and an occupied area of the foldable horizontal bar in the partially-folded state.

In some embodiments, when the first movable part is folded and the second movable part is unfolded, the first movable part, the second movable part, and the fixed part may form an unsymmetrical structure.

In some embodiments, each of the first movable part and the second movable part may include a top surface and a bottom surface. A first area of the top surface may be less than or equal to a second surface of the bottom surface.

In some embodiments, each support of the pair of supports may include a position limiting slot configured to fix the first movable part or the second movable part when the foldable horizontal bar is in the folded state.

In some embodiments, the foldable horizontal bar may further include a first rod that is detachably connected with the first movable parts of the pair of bases; and a second rod that is detachably connected with the second movable parts of the pair of bases.

In some embodiments, the first rod may be movable with respect to the first movable parts of the pair of bases; and/or the second rod may be movable with respect to the second movable parts of the pair of bases.

In some embodiments, each support of the pair of supports may include a fixed supporting part and a slide supporting part. The slide supporting part may be slidable with respect to the fixed supporting part such that a distance between the horizontal bar and the pair of bases is adjustable.

In some embodiments, each of the first movable part and the second movable part may be made of a material with a first density, and the fixed part may be made of a material with a second density greater than the first density.

In some embodiments, the foldable horizontal bar may further include a non-slip structure that is detachably mounted on the horizontal bar.

In some embodiments, the foldable horizontal bar may further include a first wheel detachably mounted on an end of each first movable part that is closer to the fixed part when the foldable horizontal bar is in the folded state; and a second wheel detachably mounted on an end of each second movable part that is closer to the fixed part when the foldable horizontal bar is in the folded state.

In some embodiments, the fixed part may include an accommodation slot for accommodating a first portion of the first movable part and a second portion of the second movable part when the foldable horizontal bar is in the unfolded state. The first portion may be a portion between the first connection position and a first end of the first movable part that is closer to the fixed part, and the second portion may be a portion between the second connection position and a second end of the second movable part that is closer to the fixed part.

In some embodiments, the first movable part may include a first bulge near the first end of the first movable part. The second movable part may include a second bulge near the second end of the second movable part. The fixed part may include a first position limiting slot for limiting the first bulge and a second position limiting slot for limiting the second bulge when the foldable horizontal bar is in the unfolded state.

In some embodiments, when the foldable horizontal bar is in the unfolded state, the first position limiting slot may be buckled on the first bulge and the second position limiting slot is buckled on the second bulge.

As another aspect of the present disclosure, uneven bars are provided. The uneven bars may include a first horizontal bar and a second horizontal bar; a first pair of supports configured to support the first horizontal bar and a second pair of supports configured to support the second horizontal bar; and a pair of bases, each base includes a first movable part, a second movable part, and a fixed part, wherein the fixed part may be mechanically connected with the first movable part and the second movable part; the first movable part may be rotatable around a first connection point between the fixed part and the first movable part within a preset angle; the second movable part is rotatable around a second connection point between the fixed part and the second movable part within the preset angle, the preset angle being larger than 90 degrees; the uneven bars may change between an unfolded state and a folded state when the first movable part and the second movable part rotate around the first connection point and the second connection point; and a distance between the first horizontal bar and the pair of bases is different from a distance between the second horizontal bar and the pair of bases.

As another aspect of the present disclosure, parallel bars are provided. The parallel bars may include a first horizontal bar and a second horizontal bar; a first pair of supports configured to support the first horizontal bar and a second pair of supports configured to support the second horizontal bar; and a pair of bases, each base may include a first movable part, a second movable part, and a fixed part, wherein the fixed part may be mechanically connected with the first movable part and the second movable part; the first movable part may be rotatable around a first connection point between the fixed part and the first movable part within a preset angle; the second movable part may be rotatable around a second connection point between the fixed part and the second movable part within the preset angle, the preset angle being larger than 90 degrees; the parallel bars may change between an unfolded state and a folded state when the first movable part and the second movable part rotate around the first connection point and the second connection point; and a distance between the first horizontal bar and the pair of bases may be the same as a distance between the second horizontal bar and the pair of bases.

Additional features will be set forth in part in the description which follows, and in part will become apparent to those skilled in the art upon examination of the following and the accompanying drawings or may be learned by the production or operation of the examples. The features of the present disclosure may be realized and attained by practice or use of various aspects of the methodologies, instrumentalities, and combinations set forth in the detailed examples discussed below.

BRIEF DESCRIPTION OF THE DRAWINGS

The present disclosure is further described in terms of exemplary embodiments. These exemplary embodiments are described in detail with reference to the drawings. These embodiments are non-limiting exemplary embodiments, in which like reference numerals represent similar structures throughout the several views of the drawings, and wherein.

DETAILED DESCRIPTION

Figure 1A:
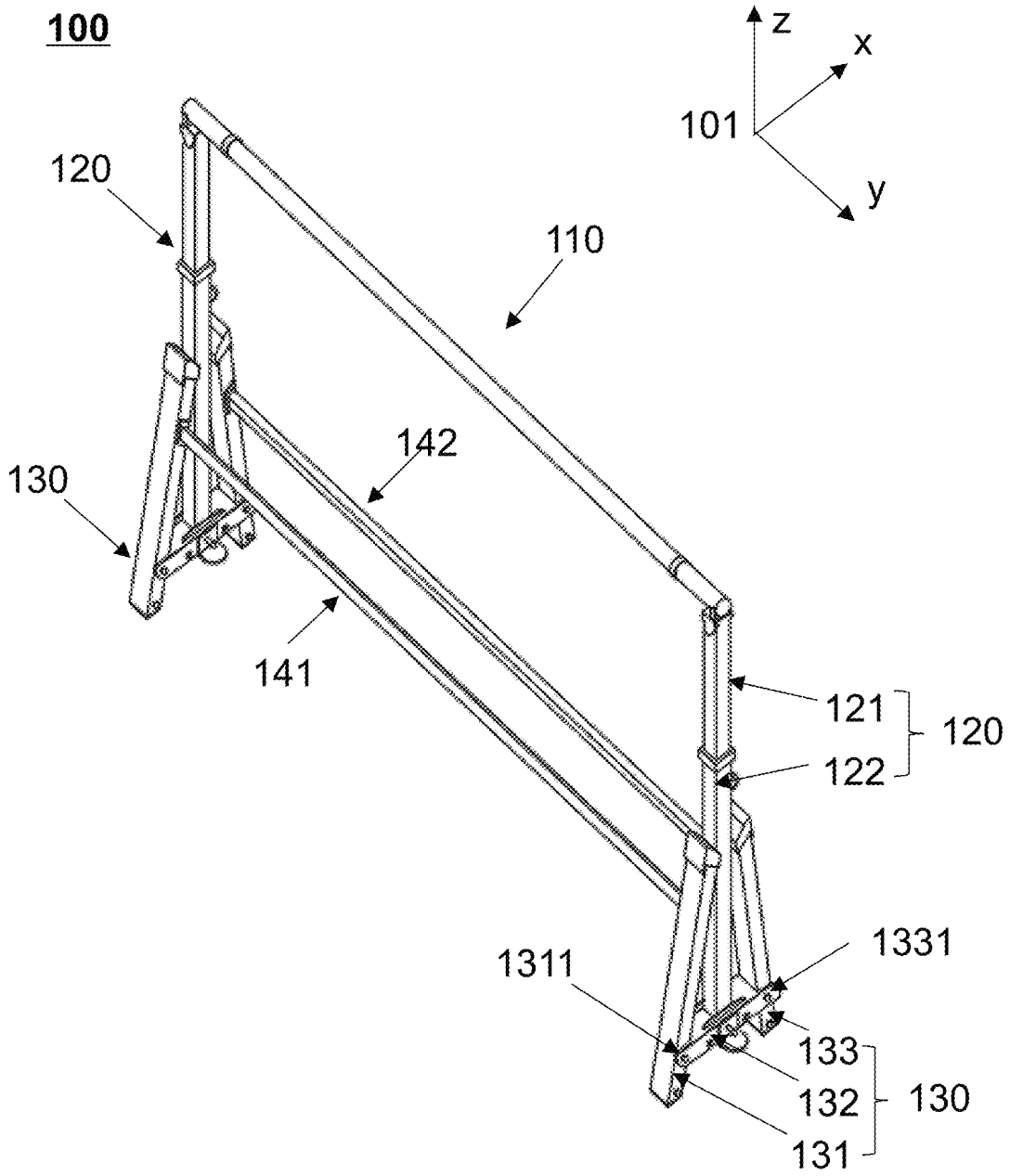
FIGS. 1A and 1B are schematic diagrams illustrating an exemplary foldable horizontal bar in a folded state according to some embodiments of the present disclosure.

In the following detailed description, numerous specific details are set forth by way of examples in order to provide a thorough understanding of the relevant disclosure. However, it should be apparent to those skilled in the art that the present disclosure may be practiced without such details. In other instances, well-known methods, procedures, systems, components, and/or circuitry have been described at a relatively high level, without detail, in order to avoid unnecessarily obscuring aspects of the present disclosure. Various modifications to the disclosed embodiments will be readily apparent to those skilled in the art, and the general principles defined herein may be applied to other embodiments and applications without departing from the spirit and scope of the present disclosure. Thus, the present disclosure is not limited to the embodiments shown, but is to be accorded the widest scope consistent with the claims.

The terminology used herein is for the purpose of describing particular example embodiments only and is not intended to be limiting. As used herein, the singular forms "a", "an," and "the" may be intended to include the plural forms as well, unless the context clearly indicates otherwise. It will be further understood that the terms "comprise," "comprises," and/or "comprising," "include," "includes," and/or "including," when used in this specification, specify the presence of stated features, integers, steps, operations, elements, and/or components, but do not preclude the presence or addition of one or more other features, integers, steps, operations, elements, components, and/or groups thereof.

It will be understood that when a unit, engine, module, or block is referred to as being "on," "connected to," or "coupled to," another unit, engine, module, or block, it may be directly on, connected or coupled to, or communicate with the other unit, engine, module, or block, or an intervening unit, engine, module, or block may be present, unless the context clearly indicates otherwise. As used herein, the term "and/or" includes any and all combinations of one or more of the associated listed items.

Spatial and functional relationships between elements are described using various terms, including "connected," "engaged," "interfaced," and "coupled." Unless explicitly described as being "direct," when a relationship between first and second elements is described in the present disclosure, that relationship includes a direct relationship where no other intervening elements are present between the first and second elements, and also an indirect relationship where one or more intervening elements are present (either spatially or functionally) between the first and second elements. In contrast, when an element is referred to as being "directly" connected, engaged, interfaced, or coupled to another element, there are no intervening elements present. Other words used to describe the relationship between elements should be interpreted in a like fashion (e.g., "between," versus "directly between," "adjacent," versus "directly adjacent," etc.).

These and other features, and characteristics of the present disclosure, as well as the methods of operation and functions of the related elements of structure and the combination of parts and economies of manufacture, may become more apparent upon consideration of the following description with reference to the accompanying drawings, all of which form a part of this disclosure. It is to be expressly understood, however, that the drawings are for the purpose of illustration and description only and are not intended to limit the scope of the present disclosure. It is understood that the drawings are not to scale.

For illustration purposes, the following description is provided to help better understand the present disclosure. It is understood that this is not intended to limit the scope of the present disclosure. For persons having ordinary skills in the art, a certain amount of variations, changes, and/or modifications may be deducted under the guidance of the present disclosure. Those variations, changes, and/or modifications do not depart from the scope of the present disclosure.

Generally, a volume and a weight of a horizontal bar are relatively large. When the horizontal bar is not used, the horizontal bar may occupy a huge space. When the horizontal bar needs to be used, it may be hard to move the horizontal bar to a target position (e.g., a training ground). An aspect of the present disclosure provides a foldable horizontal bar. The foldable horizontal bar may include a horizontal bar, a pair of supports configured to support the horizontal bar, and a pair of bases. Each base may include a first movable part, a second movable part, and a fixed part. The foldable horizontal bar may change between an unfolded state and a folded state when the first movable part and the second movable part rotate around a first connection point and a second connection point. Further, in some embodiments, the foldable horizontal bar may include a first wheel and a second wheel. According to the embodiments of the present disclosure, by providing the first movable part and the second movable part, the foldable horizontal bar may be folded easily and occupy a relatively small space in the folded space. In addition, by providing the first wheel and the second wheel, the foldable horizontal bar can be easily moved to different positions, thereby improving the utilization rate and the transportation efficiency of the foldable horizontal bar.

Figure 1B:
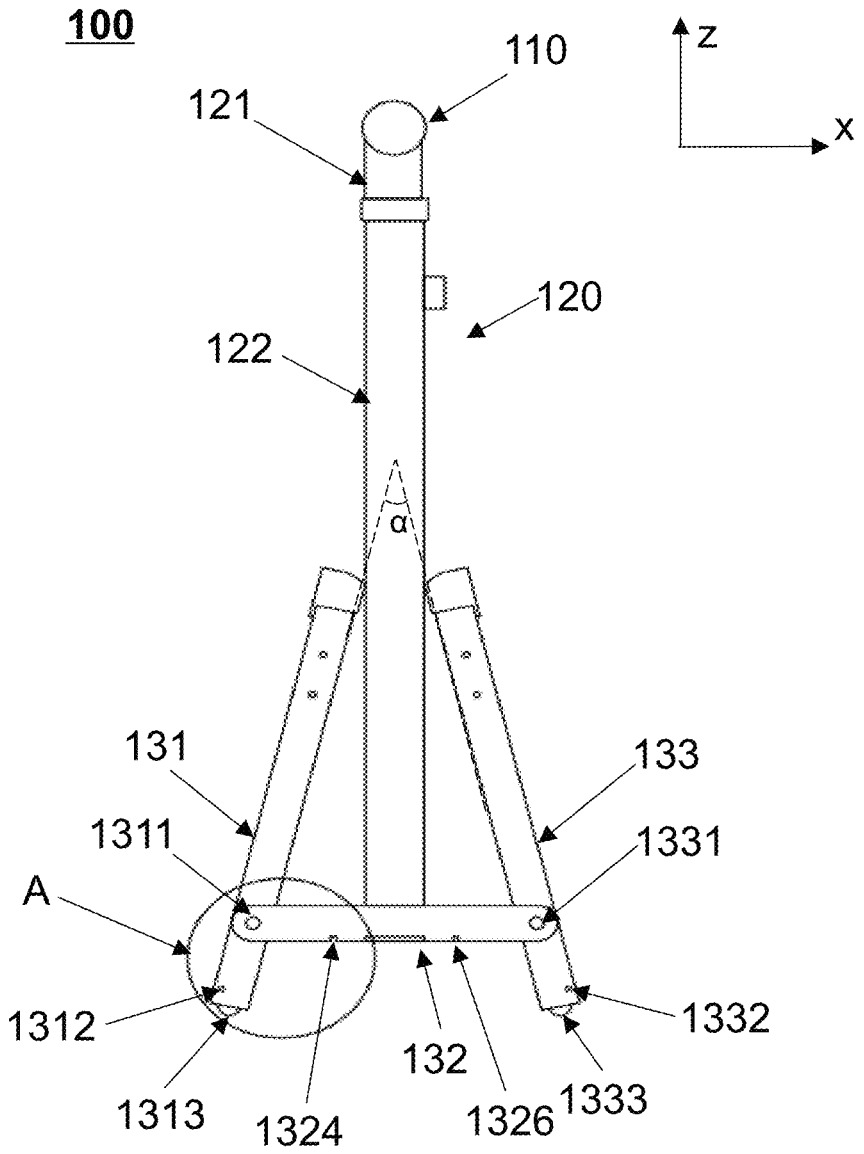

FIGS. 1A and 1B are schematic diagrams illustrating an exemplary foldable horizontal bar in a folded state according to some embodiments of the present disclosure. Specifically, FIG. 1A shows a perspective view of a foldable horizontal bar 100 in the folded state, and FIG. 1B shows a side view of the foldable horizontal bar 100 in the folded state. As shown in FIG. 1, the foldable horizontal bar 100 may include a horizontal bar 110, a pair of supports 120, and a pair of bases 130.

For illustration purposes, a coordinate system 101 is provided for describing the foldable horizontal bar 100. The coordinate system 101 may include an x-axis, a y-axis, and a z-axis. The x-axis is along a width direction of the foldable horizontal bar 100. The y-axis is along a longitude direction of the foldable horizontal bar 100 (i.e., an extension direction of the horizontal bar 110). The z-axis is along a height direction of the foldable horizontal bar 100 (i.e., a direction from the horizontal bar 110 to the ground).

The horizontal bar 110 may be a rod that is supported by the pair of supports 120. In some embodiments, materials of the horizontal bar may include wood, aluminum alloy, glass fiber, plastic, or the like, or any combination thereof. In some embodiments, a length of the horizontal bar 110 may be in a range of 60-250 cm. For example, a length of the horizontal bar 110 may be in a range of 80-200 cm. As another example, a length of the horizontal bar 110 may be in a range of 100-180 cm. As still another example, a length of the horizontal bar 110 may be in a range of 120-150 cm. For instance, the length of the horizontal bar 110 may be 130 cm. In some embodiments, a length of the horizontal bar 110 may be determined based on actual requirements of physical training, which may not be limited in the present disclosure.

In some embodiments, a surface of the horizontal bar 110 may be smooth. In some embodiments, the surface of the horizontal bar 110 may be coarse. In some embodiments, a non-slip structure may be provided on the horizontal bar 110. The non-slip structure may be configured to adjust a friction between the horizontal bar 110 and a user of the foldable horizontal bar 100. More descriptions of the non-slip structure may be found elsewhere in the present disclosure, for example, FIG. 9 and the relevant description thereof.

The pair of supports 120 may be configured to support the horizontal bar 110. In some embodiments, each support 120 of the pair of supports 120 may include a sliding supporting part 121 and a fixed supporting part 122. The sliding supporting part 121 may be slidable with respect to the fixed supporting part 122. For example, two sliding supporting parts 121 may slide with respect to their corresponding fixed supporting parts 122, such that a distance between the horizontal bar 110 and the pair of bases 130 is adjustable. That is, a height of the horizontal bar 110 along the z-axis may be adjustable by adjusting the sliding supporting parts 121. More descriptions of the sliding supporting part 121 and the fixed supporting part 122 may be found elsewhere in the present disclosure, for example, FIG. 6 and the relevant descriptions thereof.

The pair of bases 130 may be configured to stabilize the foldable horizontal bar 110 (e.g., the pair of supports 120). For example, each base 130 may be configured to support one support of the pair of supports 120. The pair of bases 130 may be configured to make the foldable horizontal bar 100 to be stable on the ground for use. In some embodiments, each base 130 may include a first movable part 131, a fixed part 132, and a second movable part 133. In some embodiments, the fixed part 132 may be arranged between the first movable part 131 and the second movable part 133. The first movable part 131 and the second movable part may have a symmetric structure.

In some embodiments, the fixed part 132 may be mechanically connected with the first movable part 131 and the second movable part 133. For example, the fixed part 132 may be connected with the first movable part 131 at a first connection point 1311 as shown in FIGS. 1A and 1B. Similarly, the fixed part 32 may be connected with the second movable part 133 at a second connection point 1331 shown in FIGS. 1A and 1B. As used herein, a connection point between two components refers to a location where the two components are connected, for example, where one or more connection components (e.g., a screw, glue) for establishing the connection between the two components are located. In some embodiments, the first movable part 131 and the second movable part 133 may be rotatable with respect to the fixed part 132. For example, the first movable part 131 may be rotatable around the first connection point 1311 between the fixed part 132 and the first movable part 131 within a preset angle. Similarly, the second movable part 133 may be rotatable around the second connection point 1331 between the fixed part 132 and the second movable part 133 within the preset angle. In some embodiments, the preset angle may be larger than 90 degrees (e.g., 120 degrees). In some embodiments, the foldable horizontal bar 100 may change between the unfolded state (as shown in FIGS. 1A and 1B) and a folded state (as shown in FIGS. 3A-3C and 4) when the first movable part 131 and the second movable part 133 rotate around the first connection point and the second connection point.

An occupied area of the foldable horizontal bar 100 in the folded state may be the minimum, an occupied area of the foldable horizontal bar 100 in the unfolded state may be the maximum, and an occupied area of the foldable horizontal bar 100 in a partially-folded state (i.e., a state between the folded state and the unfolded state) may be between the occupied area of the foldable horizontal bar 100 in the folded state and the occupied area of the foldable horizontal bar 100 in the unfolded state. That is, the foldable horizontal bar 100 in the folded state may be stored with the smallest volume compared with a volume of the foldable horizontal bar 100 in the unfolded state or the partially-folded state. In some embodiments, when the foldable horizontal bar 100 is in the unfolded state, the horizontal bar 110 may be used normally, and the horizontal bar 110 may bear a weight less than 1000 kg. When the foldable horizontal bar 100 is in the folded state or the partially-folded state, though the foldable horizontal bar 100 may still be used, a center of gravity of the foldable horizontal bar 100 may change, and a weight that the horizontal bar 110 can bear may change accordingly.

In some embodiments, one or more first connection components may be configured at the first connection point 1311 to establish the connection between the first movable part 131 and the fixed part 132. For example, one or more screws extending along the y-axis may be used to mount the first movable part 131 on the fixed part 132. The first movable part 131 may rotate around the screw(s) (i.e., rotate around a direction parallel to the y-axis). In some embodiments, the first connection component(s) may be configured to control a rotation of the first movable part 131 with respect to the fixed part 132. Similarly, one or more second connection components may be configured at the second connection point 1331 to establish the connection between the second movable part 132 and the fixed part 132, and the second movable part 133 may rotate around the one or two second connection components. The structure of the second connection component may be similar to the first connection component. More descriptions of the connection between the fixed part 132 and the first movable part 131 (and/or the second movable part 133) may be found elsewhere in the present disclosure, for example, FIGS. 4 and 5 and the relevant descriptions thereof.

In some embodiments, each of the first movable part 131 and the second movable part 133 may include a material with a first density, and the fixed part 132 may include a material with a second density greater than the first density. Thus, a weight of the fixed part 132 may be greater than a weight of each of the first movable part 131 and the second movable part 133. The fixed part 132 with a great weight may improve the stability of the foldable horizontal bar 100, and the first movable part 131 and the second movable part 133 with a small weight may make it convenient for rotating the first movable part 131 and the second movable part 133, which in turn improves the convenience for storing and moving the foldable horizontal bar 100. In some embodiments, the material with the first density may include aluminum alloy, or other metal alloys, or any combination thereof. In some embodiments, the material with the second density may include hard metal with a density greater than the first density, such as iron, stainless steel, or the like.

In some embodiments, each of the first movable part 131 and the second movable part 133 may include a top surface and a bottom surface. As used herein, a bottom surface of a component refers to a surface adjacent to the ground when foldable horizontal bar 100 is in the unfolded state, and a top surface of the component refers to a surface opposite to the bottom surface. In some embodiments, for each of the first movable part 131 and the second movable part 133, a first area of the top surface may be less than or equal to a second area of the bottom surface. Such design may improve the stability of the foldable horizontal bar 100 in the unfolded state. In some embodiments, for each of the first movable part 131 and the second movable part 133, the first area of the top surface may be the same as the second area of the corresponding bottom surface.

In some embodiments, the foldable horizontal bar 100 may further include a first rod 141 that is detachably connected with the first movable parts 131 of the pair of bases 130, and a second rod 142 that is detachably connected with the second movable parts 133 of the pair of bases 130. The first rod 141 and the second rod 142 may improve the stability of the foldable horizontal bar 100. In some embodiments, the first rod 141 and the second rod 142 may be connected with the first movable parts 131 and the second movable parts 133 respectively by using a mechanical connection including, e.g., latches, screws, bolts, or the like, or any combination thereof. In some embodiments, a portion of the first rod 141 may be inserted into the first movable parts 131, and a portion of the second rod 142 may be inserted into the second movable parts 133. In some embodiments, the first rod 141 may be movable with respect to the first movable parts 131 of the pair of bases 130, and the second rod 142 may be movable with respect to the second movable parts 133 of the pair of bases 130. That is, a position of the first rod 141 with respect to the first movable parts 131 and/or a position of the second rod 142 with respect to the second movable parts 132 may change. For example, the first rod 141 may be disposed in a medium position of the first movable parts 131. As another example, the first rod 141 may be moved to an edge position (e.g., near an end) of the first movable parts 131. Similarly, the second rod 142 may be moved to different positions of the second movable parts 132. By using the movable first rod 141 and the movable second rod 142, different usage requirements can be met. For example, when the foldable horizontal bar 100 is in the partially-folded state, the first rod 141 and the second rod 142 may be moved to positions adjacent to the fixed part 132 so that the user can use the foldable horizontal bar 100. When the foldable horizontal bar 100 is in the un-folded state, the first rod 141 and the second rod 142 may be moved to positions far away from the fixed part 132 to improve the stabilization of the foldable horizontal bar 100.

In some embodiments, the length of the first rod 141 and the length of the second rod 142 may be equal to (or substantially equal to) the length of the horizontal bar 110. In some embodiments, the first rod 141 and the second rod 142 may be parallel to the horizontal bar 110. That is, the first rod 141 or the second rod 142 may extend along a direction parallel to an extension direction of the horizontal bar 110 (i.e., a direction along the y-axis). In some embodiments, a material of the first rod 141 and/or the second rod 142 may be the same as or similar to the material of the first movable part 131 or the second movable part 133. In some embodiments, a material of the first rod 141 and/or the second rod 142 may be the different from the material of the first movable part 131 or the second movable part 133. For example, the first movable part 131 and/or the second movable part 133 may be made of aluminum alloy, while the first rod 141 and/or the second rod 142 may be made of a material with a smaller density than the aluminum alloy, such as carbon fiber, or the like.

Figure 3A:
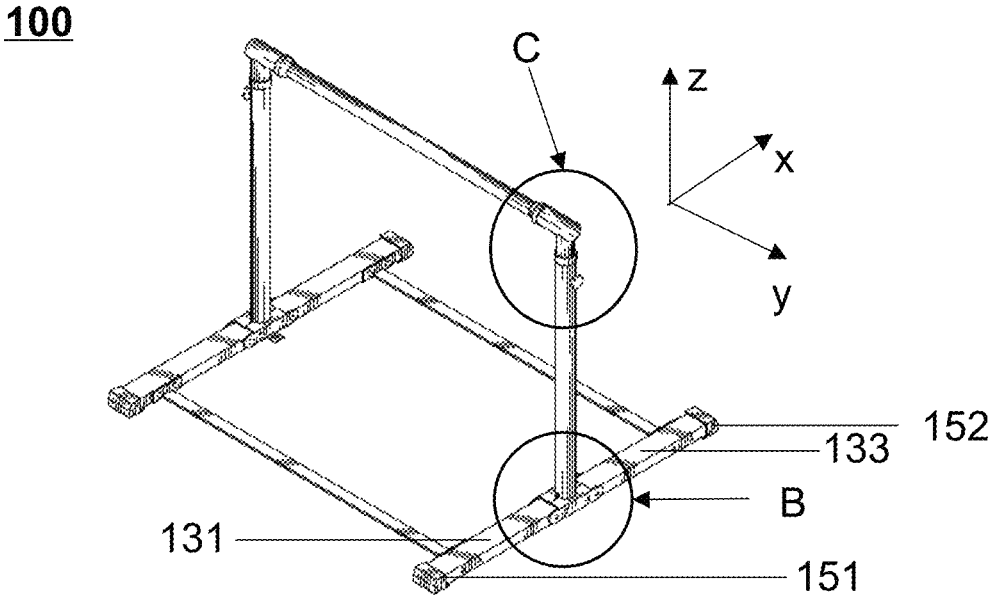
FIGS. 3A, 3B, and 3C are schematic diagrams illustrating the foldable horizontal bar 100 in an unfolded state according to some embodiments of the present disclosure.
Figure 3B:
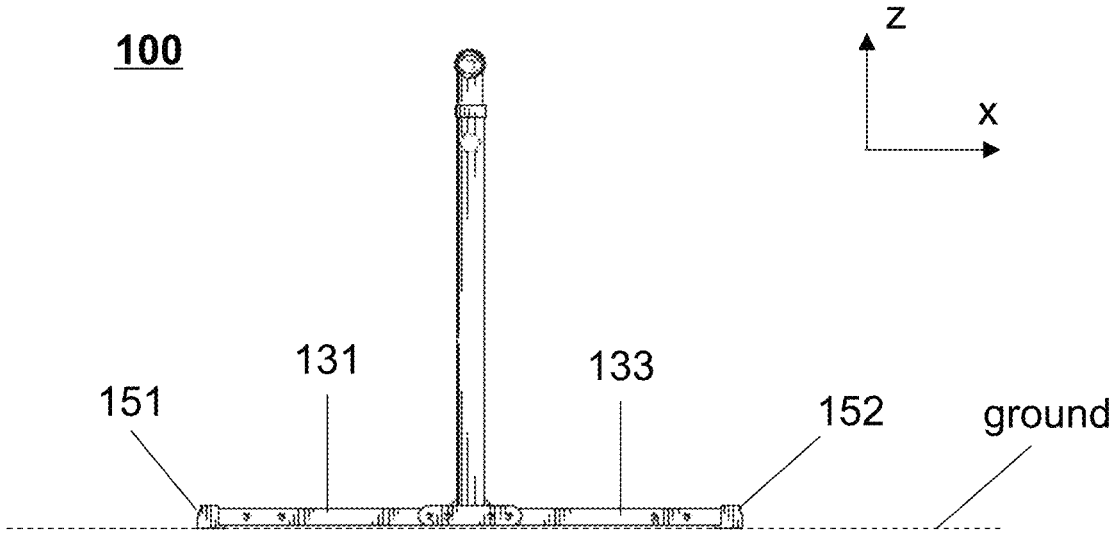
Figure 3C:
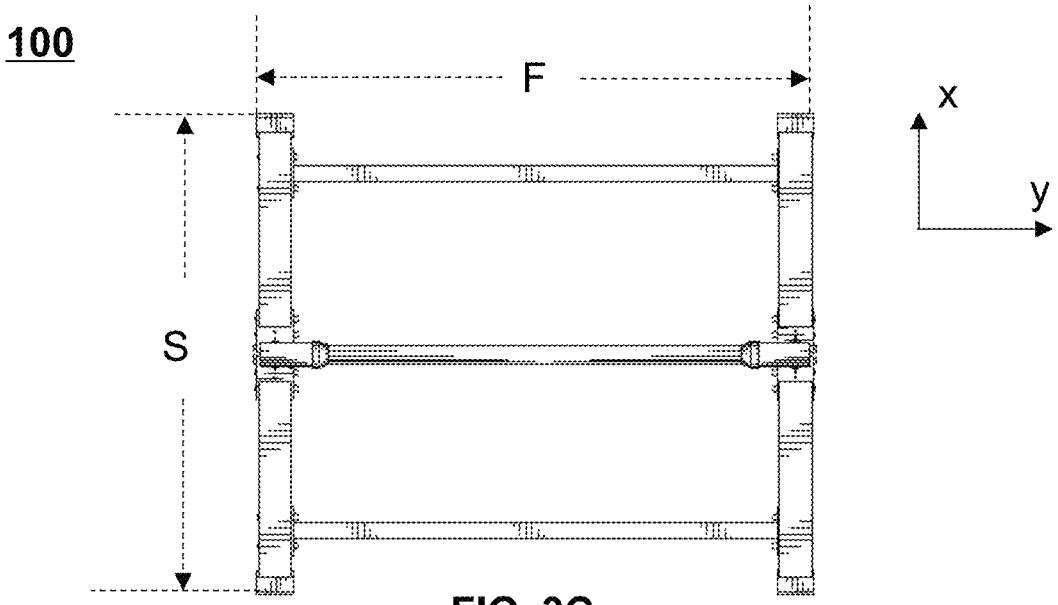

In some embodiments, the first rod 141 and the second rod 142 may be spaced apart from the ground by a certain distance when the foldable horizontal bar 100 is in an unfolded state. In some embodiments, the first rod 141 and the second rod 142 may touch the ground when the foldable horizontal bar 100 is in an unfolded state. In some embodiments, balance components (not shown) may be provided on the first rod 141 and/or the second rod 142. The balance components may contact with the ground to support the foldable horizontal bar 100 when the foldable horizontal bar 100 is in the unfolded state. For example, the balance components may be used to keep a balance of the foldable horizontal bar 100 in the unfolded state when the ground where the foldable horizontal bar 100 is located is uneven. Thus the foldable horizontal bar 100 may be used in different application scenarios (e.g., in an indoor ground or an outdoor lawn ground). In some embodiments, a balance component may include a cushion block/pad. In some embodiments, a shape of a balance component may include a rectangular shape, a columnar shape, a discoid shape, or the like. In some embodiments, a balance component may be disposed on a medium position of the first rod 141 or the second rod 142. In some embodiments, a balance component may be disposed on the bottom surface of a corresponding first rod 141 or the second rod 142. When the foldable horizontal bar is in the unfolded state, the first rod 141 or the second rod 142 may contact with the ground via the balance components. That is, the balance components may contact with the ground directly. Thus, the foldable horizontal bar 100 may also contact with the ground via the balance components on the first rod 141 and the second rod 142. The larger a contact area between the balance components and the ground, the more stable the foldable horizontal bar 100 in the unfolded state is on the ground, which in turn improves the safety of using the foldable horizontal bar 100 in the unfolded state. In some embodiments, the balance components provided on first rod 141 and/or the second rod 142 may be similar to the balance components provided on the first movable parts 131 and/or the second movable parts 133, which will be described in detail in connection with FIGS. 3A-3C is not repeated.

In some embodiments, the foldable horizontal bar 100 may include a first length along the extension direction of the horizontal bar 110 (e.g., a direction along the y-axis) and a second length along an extension direction of the fixed part 132 (e.g., a direction along the x-axis). When the foldable horizontal bar 100 is in the unfolded state (e.g., as illustrated in FIG. 3C), a ratio of the first length (denoted by F) to the second length (denoted by S) may be equal to or substantially equal to 1:1. That is, F may be equal to or substantially equal to S. In some embodiments, when the foldable horizontal bar 100 is in the folded state (e.g., as illustrated in FIG. 1A), the ratio of the first length to the second length may be equal to or substantially equal to 4:1, 3:1, 5:1, or the like. In some embodiments when the foldable horizontal bar 100 is in a partially-folded state, the ratio of the first length to the second length may be from 1:1 to 4:1 (or 3:1, 5:1, or the like).

In some embodiments, when the foldable horizontal bar 100 is in the folded state or a partially-folded state, the first movable part 131 may be divided into two portions distributed on two sides of an end of the fixed part 132; and the second movable part 133 may be divided into two portions distributed in two sides of another end of the fixed part 132. In some embodiments, the first movable part 131, the second movable part 133, and the fixed part 132 may form a triangle shape when the foldable horizontal bar 100 is in the folded state or a partially-folded state. In some embodiments, a top angle (denoted by $\angle\alpha$ as shown in FIG. 1B) of the triangle shape may be in a range from 60 degrees to 90 degrees, i.e., $\angle\alpha$=[60°, 90° ]. For example, the top angle may be 60 degrees, 66 degrees, 70 degrees, 74 degrees, 80 degrees, 85 degrees, 90 degrees, etc. Since the triangle shape is formed by the first movable part 131, the second movable part 133, and the fixed part 132, the foldable horizontal bar 100 may keep stand independently without any assistance, and the volume of the foldable horizontal bar 100 in the folded state may be reduced, thus a space for accommodating the foldable horizontal bar 100 may be saved.

In some embodiments, when the foldable horizontal bar 100 is in the folded state, a fixed connection component (e.g., an elastic belt) (not shown) may be provided to establish a connection between the first rod 141 and the second rod 142. The fixed connection component may be used to further fix the first movable parts 131 and the second movable parts 133 connected with the first rod 141 and the second rod 142. Thus, the triangle shape formed by the first movable part 131, the second movable part 133, and the fixed part 132 may be more stable, thereby improving the stability of the foldable horizontal bar 100 in the folded state.

In some embodiments, as illustrated in FIG. 1B, the first movable part 131 may include a first bulge 1312 near a first end of the first movable part 131, and the second movable part 133 may include a second bulge 1332 near a second end of the second movable part 133. The first end of the first movable part 131 refers to an end of the first movable part 131 that is close to the ground when the foldable horizontal bar 100 is in the folded state. The second end of the fixed part 132 refers to an end of the fixed part 132 that is close to the ground when the foldable horizontal bar 100 is in the folded state. The fixed part 132 may include a first position limiting slot 1324 for limiting the first bulge 1312 and a second position limiting slot 1326 for limiting the second bulge 1332 when the foldable horizontal bar is in the unfolded state. In some embodiments, the foldable horizontal bar 100 may further include one or more first movable components 1313 corresponding to the first movable parts 131 and one or more second movable components 1333 corresponding to the second movable parts 133. As shown in FIG. 1B, the first movable component 1313 and the second movable component 1333 may be wheels. More descriptions of the movable components, position limiting slots, and the bulges may be found elsewhere in the present disclosure, for example, FIG. 2 and the relevant description, which is not repeated herein.

It should be noted that the descriptions of the foldable horizontal bar 100 are merely provided for the purposes of illustration, and not intended to limit the scope of the present disclosure. For persons having ordinary skills in the art, multiple variations and modifications may be made under the teachings of the present disclosure. However, those variations and modifications do not depart from the scope of the present disclosure. In some embodiments, the foldable horizontal bar 100 may include one or more components not shown in the FIGS. 1A and 1B. In some embodiments, one or more components in the foldable horizontal bar 100 may be omitted. In some embodiments, the first rod 141 and the first movable parts 131 may be manufactured by integral molding, and the first rod 141 may be not movable with respect to the first movable parts 131.

Figure 2:
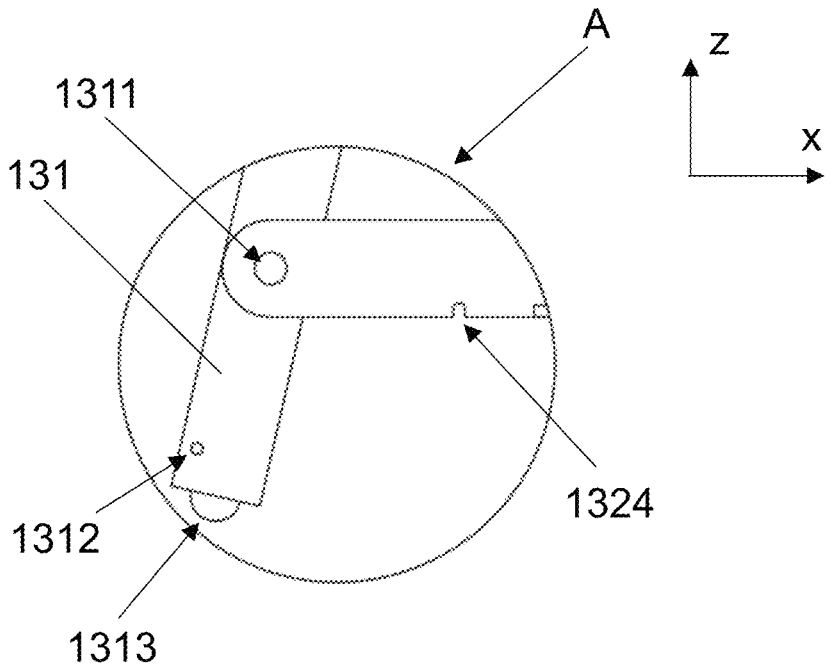
FIG. 2 is a schematic diagram illustrating an enlarged view of region A of the foldable horizontal bar illustrated in FIG. 1B according to some embodiments of the present disclosure.

FIG. 2 is a schematic diagram illustrating an enlarged view of region A of the foldable horizontal bar 100 illustrated in FIG. 1B according to some embodiments of the present disclosure.

As described in connection with FIGS. 1A and 1B, the foldable horizontal bar 100 may further include the first movable component(s) 1313 and the second movable component(s) 1333. As illustrated in FIG. 2, a first movable component 1313 may be detachably mounted on the first end of a first movable part 131 that is close to the ground when the foldable horizontal bar 100 is in the folded state. Similarly, a second wheel 1333 (not shown in FIG. 2) may be detachably mounted on the second end of a corresponding second movable part 133 that is close to the ground when the foldable horizontal bar 100 is in the folded state. Through the first movable component(s) 1313 and the second movable component(s) 1333, the foldable horizontal bar 100 in the folded state may be moved easily and smoothly. Thus, the adaptability of the foldable horizontal bar 100 for different application scenarios may be improved.

As described in connection with FIGS. 1A and 1B, the first movable part 131 may include the first bulge 1312 near the first end of the first movable part 131, the second movable part 133 may also include the second bulge 1332 (not shown in FIG. 2) near the second end of the second movable part 133, and the fixed part 132 may include the first position limiting slot 1324 for limiting the first bulge 1312 and the second position limiting slot 1326 (not shown in FIG. 2) for limiting the second bulge 1332 when the foldable horizontal bar 100 is in the unfolded state. When the foldable horizontal bar 100 is in the unfolded state, the first position limiting slot 1324 may be buckled on the first bulge 1312, and the second position limiting slot 1326 may be buckled on the second bulge 1324. Thus, the first movable part 131 and the second movable part 133 may be fixed on the fixed part 132 tightly through the two bulges (i.e., the first bulge 1312 and the second bulge 1332) and the two position limiting slots (i.e., the first position limiting slot 1324 and the second position limiting slot 1326), which improves the stability and/or safety of the foldable horizontal bar 100 in the unfolded state.

Figure 4:
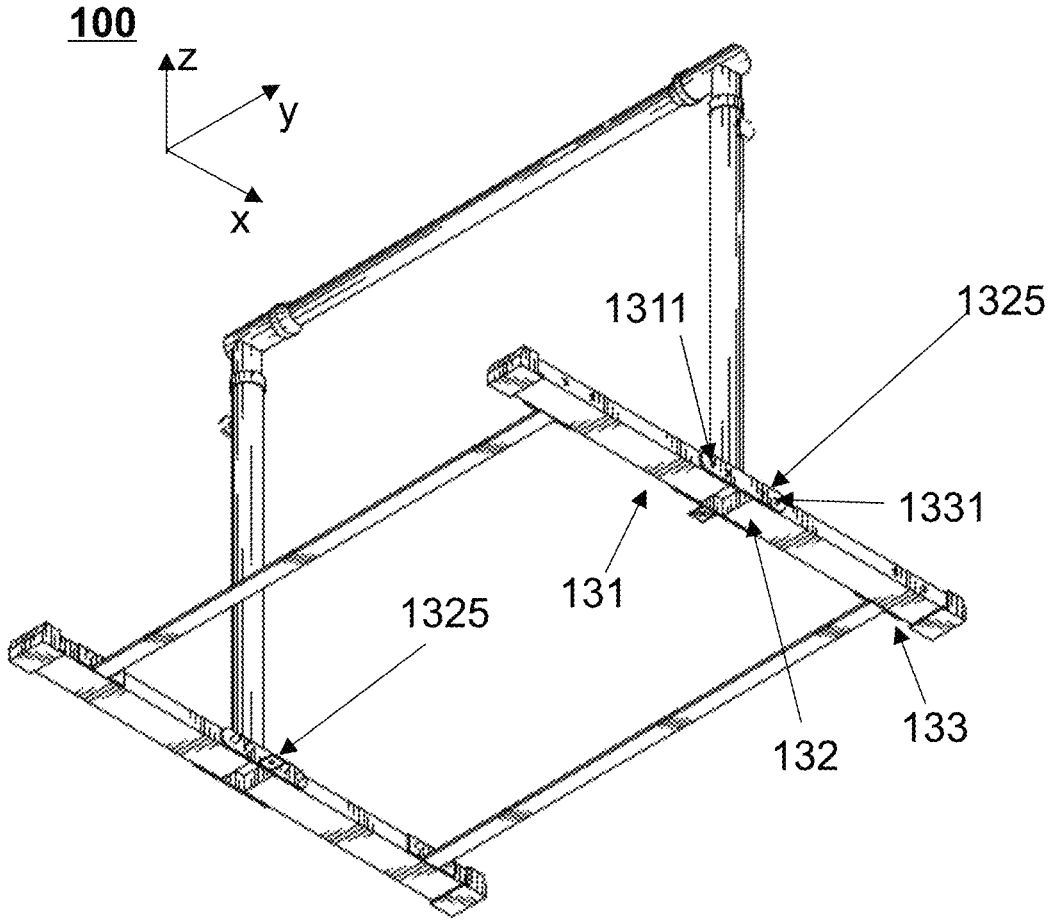
FIG. 4 is a schematic diagram illustrating an exemplary foldable horizontal bar in an unfolded state according to some embodiments of the present disclosure

FIGS. 3A, 3B, 3C, and 4 are schematic diagrams illustrating the foldable horizontal bar 100 in an unfolded state according to some embodiments of the present disclosure. Specifically, FIG. 3A illustrates a perspective view of the foldable horizontal bar 100 in the unfolded state seen from the top down; FIG. 3B illustrates a side view of the foldable horizontal bar 100 in the unfolded state; FIG. 3C illustrates a vertical view of the foldable horizontal bar 100 in the unfolded state; and FIG. 4 illustrates a perspective view of the foldable horizontal bar 100 in the unfolded state seen from the bottom up.

In some embodiments, the fixed part 132 may have a U-shape with an opening facing the ground. For example, the fixed part 132 may include an accommodation slot 1325 for accommodating a first portion of the first movable part 131 and a second portion of the second movable part 133 when the foldable horizontal bar 100 is in the unfolded state, e.g., as illustrated in FIG. 4. The first portion of the first movable part 131 may be a portion between the first connection position 1311 and the first end of the first movable part 131 that is closer to the fixed part 132, and the second portion of the second movable part 132 may be a portion between the second connection position 1331 and the second end of the second movable part 133 that is closer to the fixed part 132. In some embodiments, a length of the first portion of the first movable part 131 may be equal to a length of the second portion of the second movable part 133. In some embodiments, the length of the first portion of the first movable part 131 may be equal to or shorter than a length of the rest portion of the second movable part 133. Similarity, the length of the second portion of the second movable part 133 may be equal to or shorter than a length of the rest portions of the second movable part 133.

In some embodiments, balance components may be provided on the first movable parts 131 and the second movable parts 133, respectively. For example, a balance component 151 may be disposed on the first movable part 131 and a balance component 152 may be disposed on the second movable part. The balance components may be configured to support the foldable horizontal bar 100 when the foldable horizontal bar 100 is in the unfolded state. For example, the balance components may be used to keep a balance of the foldable horizontal bar 100 in the unfolded state when the ground where the foldable horizontal bar 100 is located is uneven. Thus, the foldable horizontal bar 100 may be used in different application scenarios (e.g., in an indoor ground or an outdoor lawn ground). In some embodiments, a balance component may include a cushion block/pad. In some embodiments, a shape of a balance component may include a rectangular shape, a columnar shape, a discoid shape, etc. In some embodiments, a balance component may cover an end of a corresponding first movable part 131 or second movable part 133 that is away from the fixed part 132. Alternatively, a balance component may be disposed on the bottom surface of a corresponding first movable part 131 or second movable part 133. When the foldable horizontal bar 100 is in the unfolded state, the foldable horizontal bar 100 may contact the ground via the balance components. As shown in FIG. 3B, the foldable horizontal bar 100 may contact the ground via the balance components 151 and 152. That is, the balance components may contact the ground directly. The larger a contact area between the balance components and the ground is, the more stable the foldable horizontal bar 100 in the unfolded state is on the ground, which in turn improves the safety of using the foldable horizontal bar 100 in the unfolded state.

In some embodiments, a surface of the balance components touching the ground may be provided with rubber, plastic, etc. In some embodiments, a non-slip component (e.g., a sucker) may be provided on a balance component and directly contact the ground. The non-slip component may be configured to further fix the foldable horizontal bar 100 on the ground. Thus, the friction between the foldable horizontal bar 100 and the ground may be improved by the rubber surfaces of the balance components and/or the non-slip components, which further improves the stability of the foldable horizontal bar 100.

In some embodiments, heights of the balance components may be adjusted for achieving/keeping the balance of the foldable horizontal bar 100 in the unfolded state. For example, height(s) of one or more balance components may be adjusted according to the actual need for the balance of the foldable horizontal bar 100. In some embodiments, an adjustable rod may be arranged between a balance component and the first movable part 131 or the second movable part 133 to connect the balance component with the first movable part 131 or the second movable part 133. Thus, a height of the balance component may be adjusted through the adjustable rod. In some embodiments, the structure of the adjustable rod may be similar to the structure of a support 120, which is not repeated herein.

Figure 5:
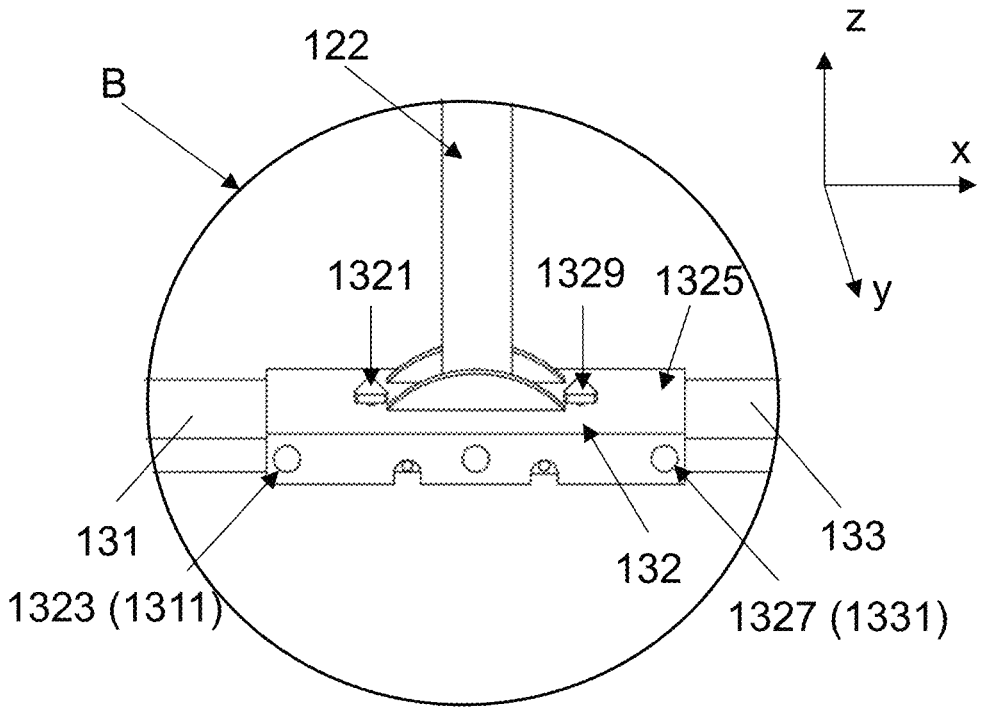
FIG. 5 is a schematic diagram illustrating an exemplary connection of a fixed part with two movable parts according to some embodiments of the present disclosure.

FIG. 5 is a schematic diagram illustrating an exemplary connection of a fixed part with two movable parts according to some embodiments of the present disclosure. FIG. 5 is an enlarged view of region B of the foldable horizontal bar 100 in the unfolded state, e.g., as shown in FIG. 4.

As shown in FIG. 5, a connection component 1323 may be arranged at the first connection point 1311 and configured to control the rotation of the first movable part 131, and a connection component 1327 may be arranged at the second connection point 1331 and configured to control the rotation of the second movable part 133.

In some embodiments, the connection components 1323 and 1327 may include screws such as rotating screws, or the like. In some embodiments, the connection components 1323 and 1327 may be tightened or released. Taking the connection component 1323 as an example, when the connection component 1323 is tightened, the first movable part 131 may not be rotated with respect to the fixed part 132 and fixedly connected with the fixed part 132. In contrast, when the connection component 1323 is released, the first movable part 131 may be allowed to rotate with respect to the fixed part 132. In some embodiments, whether the connection component 1323 or 1327 is tightened or released may be determined based on the actual application scenarios of the foldable horizontal bar 100, which may not be limited in the present disclosure. For instance, the connection components 1323 and 1327 may be tightened so that the first movable part 131 and the second movable part 133 are fixedly connected with the fixed part 132 when the foldable horizontal bar 100 is in the unfolded state for use.

In some embodiments, two locking components 1321 and 1329 may be arranged on the fixed part 132 and distributed on two sides of the fixed supporting part 122. The locking components 1321 and 1329 may include screws such as locking screws, or the like. The locking components 1321 and 1329 may be used to assist the control of a rotation of the first movable part 131 and the second movable part 133, respectively. For example, the first movable part 131 may correspond to the locking component 1321 and the connection component 1323, and the second movable part 133 may correspond to the locking component 1329 and the connection component 1327. When the locking component 1321 corresponding to the first movable part 131 is tightened, though a corresponding connection component 1323 is released, the first movable part 131 may not rotate with respect to the fixed part 132. When the locking component 1321 and the connection component 1323 corresponding to the first movable part 131 are both released, the first movable part 131 may rotate with respect to the fixed part 132. The second movable part 133 may be controlled by the locking component 1329 and the connection component 1327, which is similar to the control of the first movable part 131. In some embodiments, the locking components 1321 and/or 1329 may be omitted from the foldable horizontal bar 100.

As illustrated in FIG. 5, the fixed supporting part 122 of the supporting 120 may be fixed on the fixed part 132. In some embodiments, the fixed supporting part 122 may be detachedly connected with the fixed part 132 by a mechanical connection including, e.g., a latch, a screw, a bolt, or the like, or any combination thereof. In some embodiments, the fixed supporting part 122 and the fixed part 132 may be manufactured by integrated molding.

Figure 6:
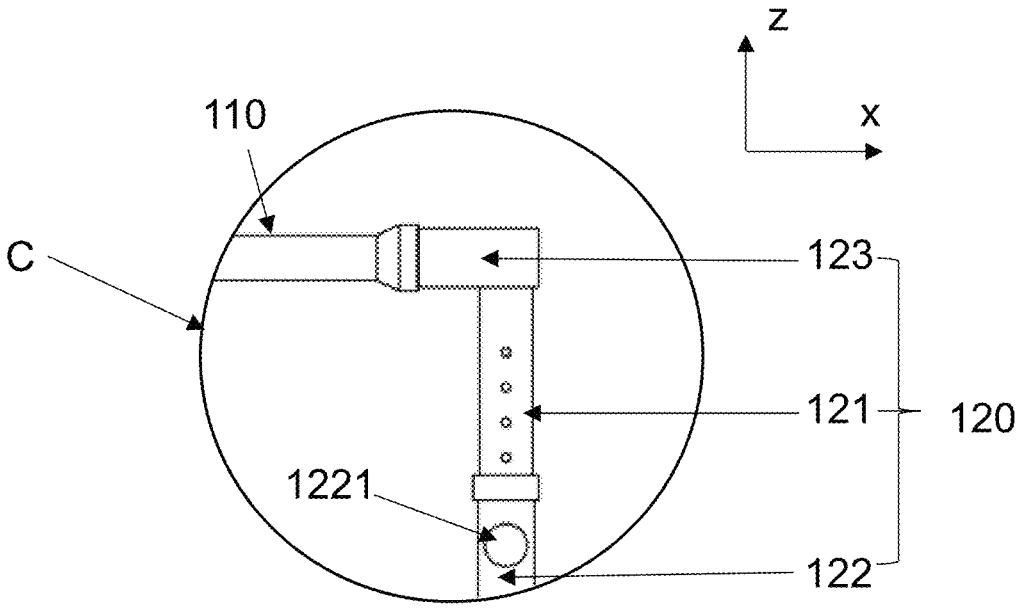
FIG. 6 is a schematic diagram illustrating an exemplary connection between a horizontal bar and a support of a foldable horizontal bar according to some embodiments of the present disclosure.

FIG. 6 is a schematic diagram illustrating an exemplary connection between a horizontal bar and a support of a foldable horizontal bar according to some embodiments of the present disclosure. FIG. 6 is an enlarged view of region C of the foldable horizontal bar 100 in the unfolded state, e.g., as shown in FIG. 4.

As described in connection with FIGS. 1A and 1B, the support 120 may include the sliding supporting part 121 and the fixed supporting part 122. The sliding supporting part 121 may be slidable with respect to the fixed supporting part 122, e.g., along the z-axis. In some embodiments, a portion of the sliding supporting part 121 may be inserted into the fixed supporting part 122. As illustrated in FIG. 6, a plurality of holes may be provided on the sliding supporting part 121. In some embodiments, the plurality of holes may be distributed on the sliding supporting part 121 at intervals (e.g., with the same interval). The diameters of the plurality of the holes may be the same. In some embodiments, a hole with the same diameter as the plurality of holes on the sliding supporting part 121 may be provided on the fixed supporting part 122. When one of the plurality holes on the sliding supporting part 121 is aligned with the hole on the fixed supporting part 122, the sliding supporting part 121 may be fixed on the fixed supporting part 122 by using a fixed component 1221 (e.g., a screw) passing through the two aligned holes. By adjusting different holes on the sliding supporting part 121 to align with the hole on the fixed supporting part 122, the sliding supporting part 121 may be slidable with respect to the fixed supporting part 122, thereby a height of the foldable horizontal bar 100 may be adjusted, such that the foldable horizontal bar 100 may be applied in different application scenarios (e.g., for different users with different heights).

In some embodiments, each support 120 may further include a connection part 123. The connection part 123 may be arranged on the sliding supporting part 121 and perpendicular to the sliding supporting part 121. The connection part 123 may be configured to connect the horizontal bar 110 with the support 120. For example, two ends of the horizontal bar 110 may be detachably connected with two connection parts 123 of the pair of supports 120 respectively. When the two ends of the horizontal bar 110 are locked on the two connection parts 123, the foldable horizontal bar 100 may be ready for use. In some embodiments, the connection part 123 and the sliding supporting part 121 of a support 120 may form an "L" shape. For example, the connection part 123 may be detachably connected with the sliding supporting part 121. For instance, the connection part 123 may be socketed on the sliding supporting part 121. As another example, the connection part 123 and the sliding supporting part 121 may be manufactured by integrated molding. In such cases, the connection part 123 may be regarded as a part of the sliding supporting part 121, and may be made by integrated molding with the sliding supporting part 121.

Figure 7:
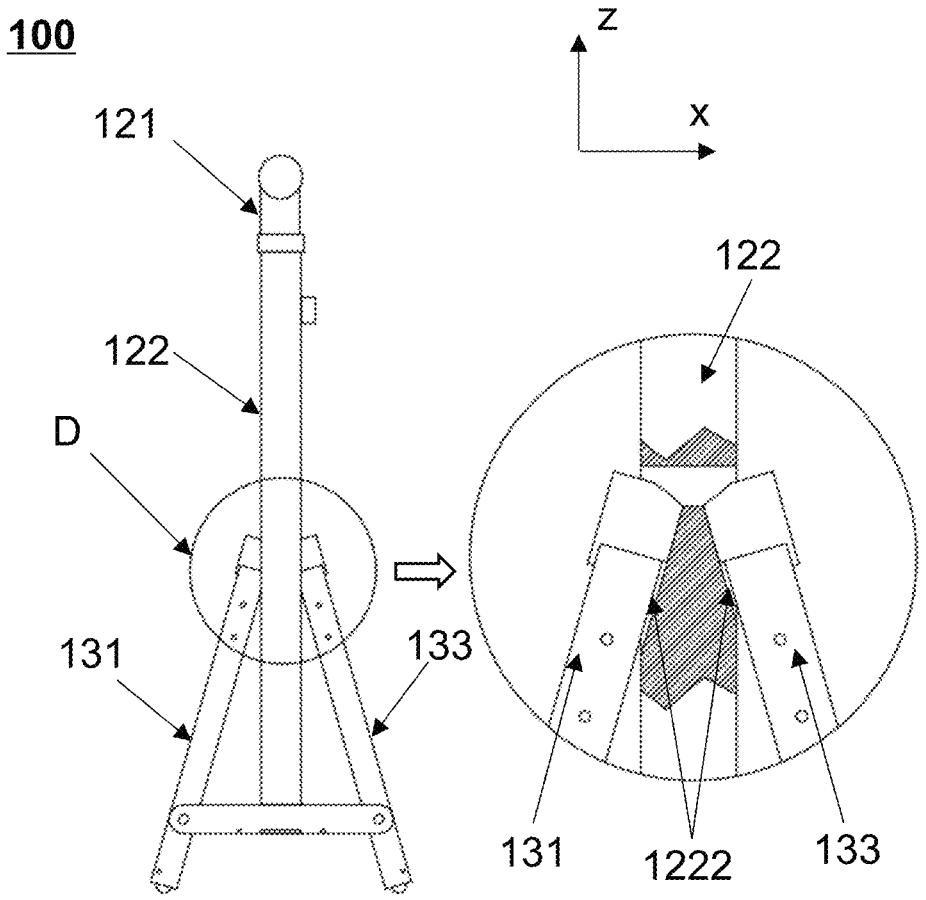
FIG. 7 is a schematic diagram illustrating an exemplary foldable horizontal bar in the folded state according to some embodiments of the present disclosure.
Figure 8:
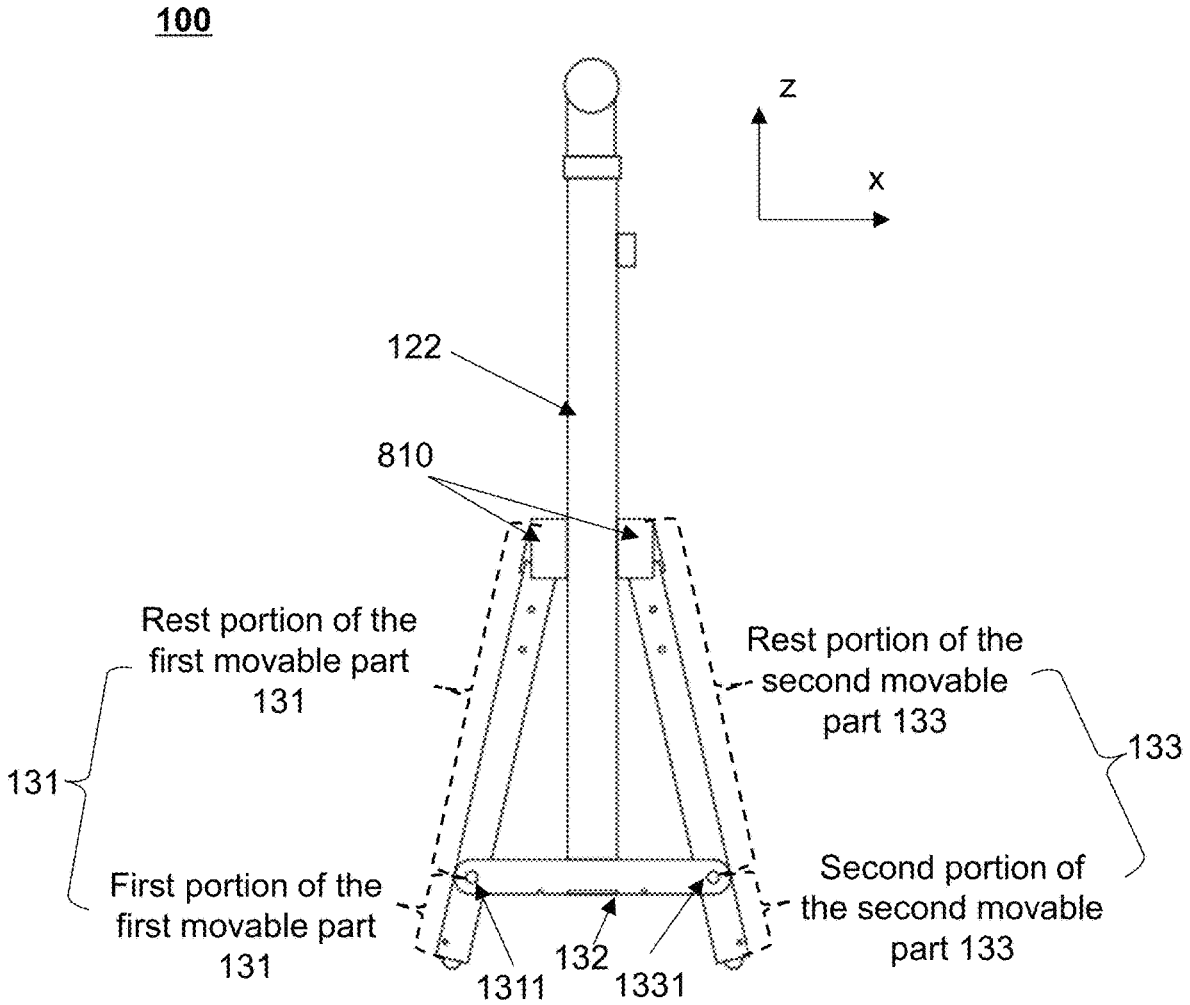
FIG. 8 is a schematic diagram illustrating an exemplary foldable horizontal bar in the folded state according to some embodiments of the present disclosure.

FIGS. 7 and 8 are schematic diagrams illustrating exemplary foldable horizontal bars in the folded state according to some embodiments of the present disclosure. In some embodiments, when the foldable horizontal bar 100 is in the folded state, the first movable parts 131 and the second movable parts 133 may be fixed on the fixed supporting part 122 using different fixation mechanisms (e.g., as shown in FIG. 7 or FIG. 8).

For example, each support 120 of the pair of supports 120 may include a position limiting slot configured to fix the first movable part 131 or the second movable part 133 when the foldable horizontal bar 100 is in the folded state. As shown in FIG. 7, when the foldable horizontal bar 100 is in the folded state, the first movable part 131 and the second movable part 133 may be fixed on the support 120 via positioning limiting slots. According to a cross-section diagram of an enlarged view of region C of the foldable horizontal bar 100, the support 120 (e.g., the fixed supporting part 122 thereof) may include two positioning limiting slots 1222 configured to accommodate and fix the first movable part 131 and the second movable part 133, respectively.

In some embodiments, the position limiting slot 1222 may be a groove extending along a thickness direction (e.g., a direction along the x-axis) of the fixed supporting part 122. For example, a sectional view where the position limiting slot 1222 is arranged on the fixed supporting part 122 may be a concave shape. In some embodiments, the position limiting slot 1222 may include two concavities to buckle the first movable part 131 and the second movable part 133 when the foldable horizontal bar 100 is in the folded state.

The position limiting slot 1222 may improve the connection strength between the first movable part 131 or the second movable part 133 and the fixed supporting part 122, thus to avoid that the first movable part 131 or the second movable part 133 may fall off when the foldable horizontal bar 100 is in the folded state, causing a safe accident.

As another example, each support 120 may include a buckle configured to fix the first movable part 131 and the second movable part 133 when the foldable horizontal bar 100 is in the folded state. As shown in FIG. 8, when the foldable horizontal bar 100 is in the folded state, the first movable part 131 and the second movable part 133 may be fixed on the support 120 via two buckles 810, respectively. For example, when the foldable horizontal bar 100 is in the folded state, the buckles 810 may be bucked on the first movable part 131 and the second movable part 133, respectively. In some embodiments, the buckle 810 may be made of hard materials, such as metals, plastic, or the like. In some embodiments, the buckle 810 may be made of soft materials, such as textiles, rubber, or the like.

It should be noted that the descriptions of the position limiting slot 1222 and/or buckle 810 are merely provided for the purposes of illustration, and not intended to limit the scope of the present disclosure. For persons having ordinary skills in the art, multiple variations and modifications may be made under the teachings of the present disclosure. However, those variations and modifications do not depart from the scope of the present disclosure. In some embodiments, the position limiting slot 1222 and the buckle 810 may be used in combination for fixing the first movable part 131 or the second movable part 132. For example, when the foldable horizontal bar 100 is in the folded state, an end of the first movable part 131 may be stuck in the position limiting slot 1221 on the fixed supporting part 122, and the buckle 810 may further be buckled on the first movable part 131 or the second movable part 133, thereby further improving the connection strength between the first movable part 131/the second movable part 133 and the fixed supporting part 122.

Figure 9:
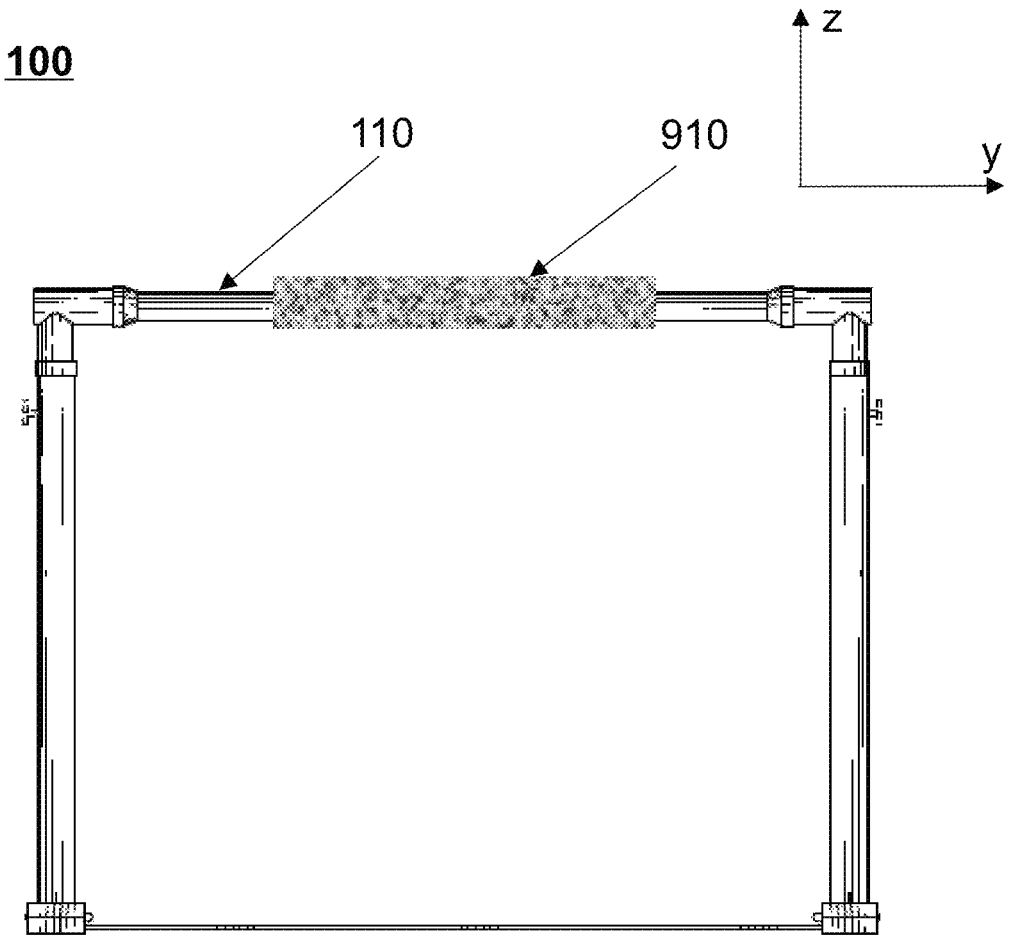
FIG. 9 is a schematic diagram illustrating an exemplary non-slip structure mounted on a horizontal bar of a foldable horizontal bar according to some embodiments of the present disclosure.

FIG. 9 is a schematic diagram illustrating an exemplary non-slip structure mounted on a horizontal bar of a foldable horizontal bar according to some embodiments of the present disclosure.

In some embodiments, the foldable horizontal bar 100 may further include a non-slip structure 910 that is detachably mounted on the horizontal bar 110. The non-slip structure 910 may be configured to improve the friction between a user (e.g., a player) and the foldable horizontal bar 100, thus avoiding the user slipping from the foldable horizontal bar 100. In some embodiments, the non-slip structure 910 may be made of rubber, plastic, or the like. In some embodiments, patterns may be provided on the non-slip structure 910. The patterns may include points, stripes, or the like.

Different sports activities may have different requirements on the smoothness of the foldable horizontal bar 100. For example, some sports activities may require a smooth surface of the horizontal bar 110, but other sports activities may require a coarse surface of the horizontal bar 110. The non-slip structure 910 may be detachably mounted on the horizontal bar 110. For example, the non-slip structure 910 may be detached from the horizontal bar 110 when there is no need for non-slip requirements. By using the detachable non-slip structure 910, the adaptability of the foldable horizontal bar 100 for different application scenarios may be improved. In some embodiments, the foldable horizontal bar 100 may be provided with a plurality of non-slip structures 910 for satisfying different application scenarios of the foldable horizontal bar 100.

Figure 10A:
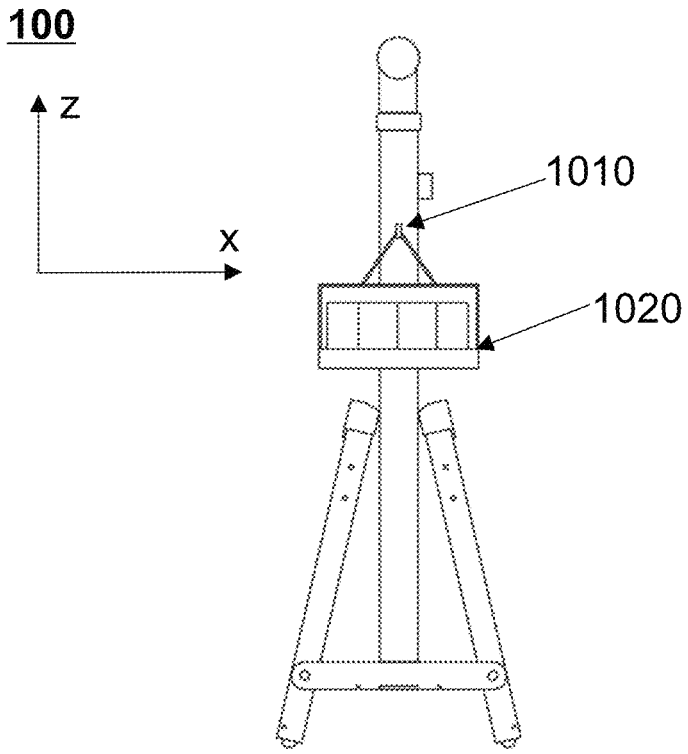
FIGS. 10A and 10B are schematic diagrams illustrating an exemplary storage structure of a foldable horizontal bar according to some embodiments of the present disclosure.
Figure 10B:
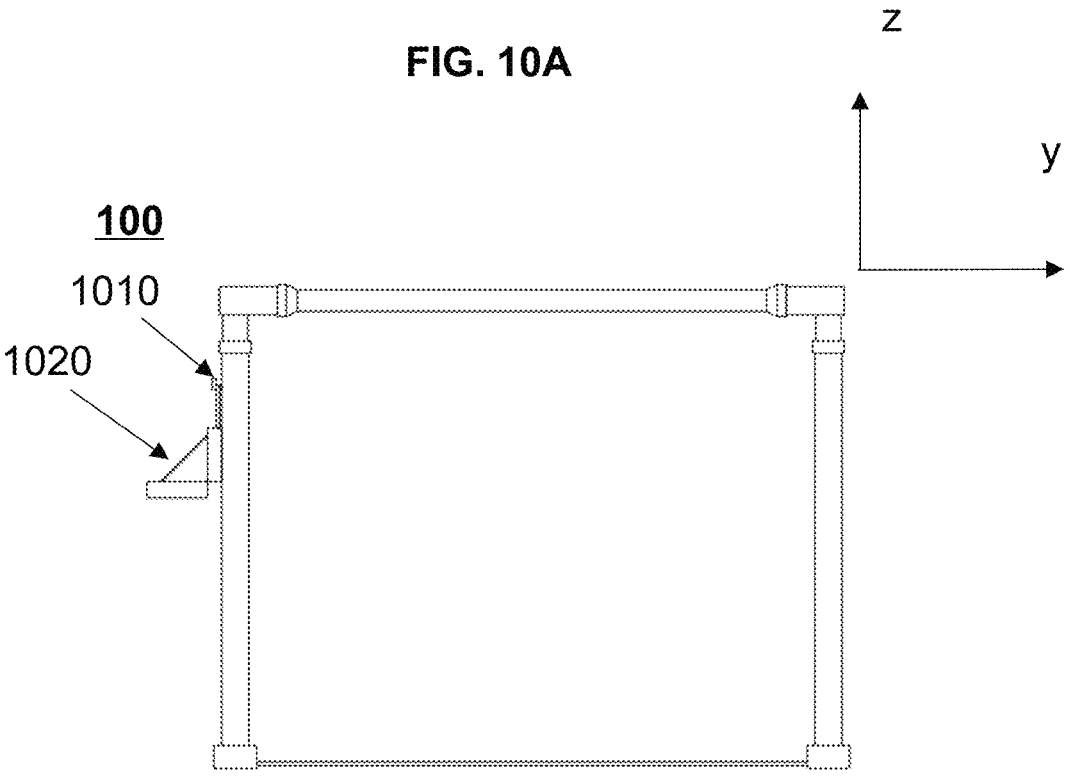

FIGS. 10A and 10B are schematic diagrams illustrating an exemplary storage structure of a foldable horizontal bar according to some embodiments of the present disclosure.

Specifically, FIG. 10A is a front view of the foldable horizontal bar 100; and FIG. 10B is a side view of the foldable horizontal bar 100.

As shown in FIGS. 10A and 10B, the foldable horizontal bar 100 may include a hook 1010 fixed on the fixed supporting part 122 and a storage structure 1020 that is detachably mounted on the fixed supporting part 122 through the hook 1010. The hook 1010 may be configured to support the storage structure 1020, and the storage structure 1020 may be configured to store sports accessories (e.g., towels, gloves, anti-slip powders, etc.) of the user.

In some embodiments, the hook 1010 may be fixed on the fixed supporting part 122 by integrated molding. In some embodiments, the hook 1020 may be detachably mounted on the fixed supporting part 122 by way of socketing, gluing, or, buckling.

In some embodiments, the storage structure 1020 may be arranged on at least one of the fixed supporting parts 122 of the pair of supports 120. In some embodiments, the storage structure 1020 may include a shelf, a basket, a bag, or the like. In some embodiments, the storage structure 1020 may be provided by a manufacturer of the foldable horizontal bar 100 or may be owned by the user, which is limited in the present disclosure.

It should be noted that the descriptions of components (e.g., the movable components, the movable parts, or the like) or structures (e.g., the connection structures between the movable parts and the fixed parts, the structures of foldable parts of the movable parts, or the like) of the foldable horizontal bar 100 are merely provided for the purposes of illustration, and not intended to limit the scope of the present disclosure. For persons having ordinary skills in the art, multiple variations and modifications may be made under the teachings of the present disclosure. However, those variations and modifications do not depart from the scope of the present disclosure.

Figure 11A:
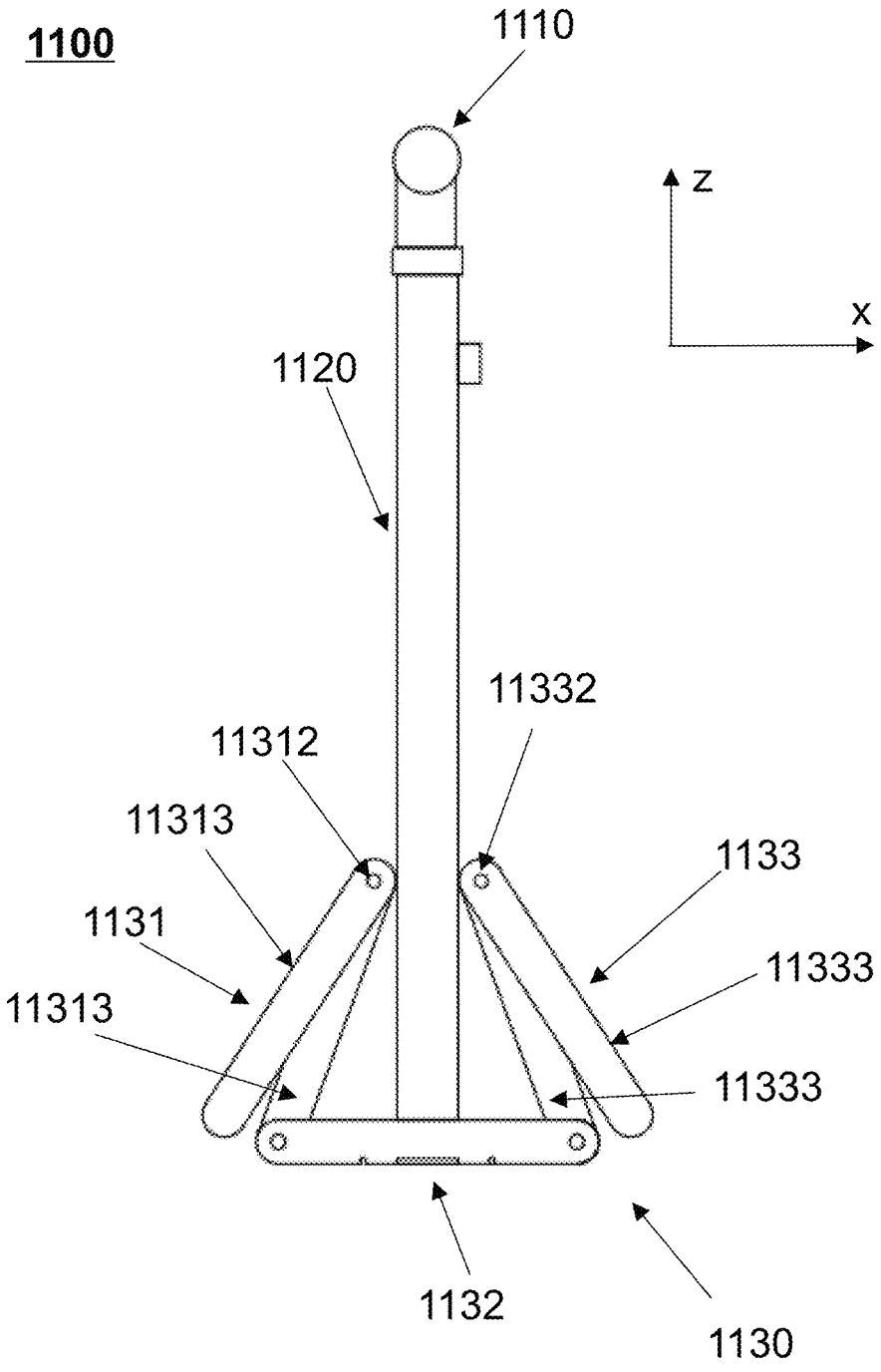
FIG. 11A is a schematic diagram illustrating an exemplary foldable horizontal bar in a folded state according to some embodiments of the present disclosure.
Figure 11B:
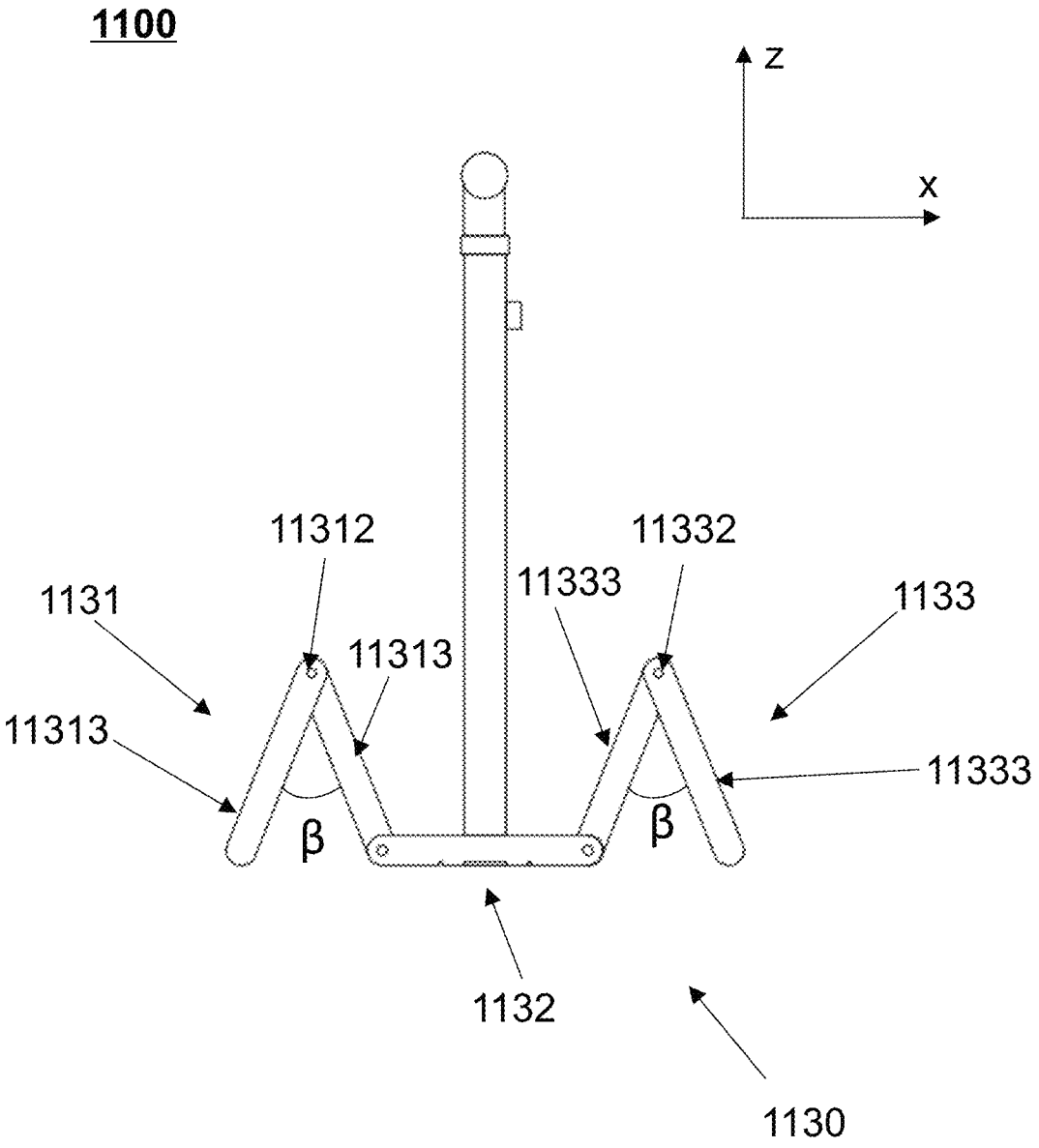
FIG. 11B is a schematic diagram illustrating an exemplary foldable horizontal bar in a partially-folded state according to some embodiments of the present disclosure.

FIG. 11A is a schematic diagram illustrating an exemplary foldable horizontal bar in a folded state according to some embodiments of the present disclosure. FIG. 11B is a schematic diagram illustrating an exemplary foldable horizontal bar in a partially-folded state according to some embodiments of the present disclosure. The foldable horizontal bar 1100 may be similar to the foldable horizontal bar 100, e.g., as shown in FIG. 1B. For example, the foldable horizontal bar 1100 may include a horizontal bar 1110, a pair of supports 1120, and a pair of bases 1130. The horizontal bar 1110 may be similar to or the same as the horizontal bar 110 of the foldable horizontal bar 100. The pair of supports 1120 may be similar to or the same as the pair of supports 120. The pair of bases 1130 may be similar to the pair of bases 130 of the foldable horizontal bar 100, except for the movable parts of the pair of bases 1130 are different from those of the pair of bases 130.

For example, each base 1130 may include a first movable part 1131, a fixed part 1132, and a second movable part 1133. The fixed part 1132 may be similar or the same as the fixed part 132 of the foldable horizontal bar 100. Different from the first movable part 131 and the second movable part 133, the first movable part 1131 and the second movable part 1133 may be foldable. In some embodiments, the first movable part 1131 may include two parts 11313 rotatably connected to each other at a third connection point 11312. Similarly, the second movable part 1133 may include two parts 11333 rotatably connected to each other at a fourth connection point 11332. Thus, the first movable part 1131 may be folded by rotating the parts 11313 around the third connection point 11312, and the second movable part 1133 may be folded by rotating the parts 11333 around the fourth connection point 11332. In some embodiments, the lengths of the two foldable parts 11313 of the first movable part 1131 may be the same with each other, and the lengths of the two foldable parts 11333 of the second movable part 1133 may be the same with each other. In some embodiments, a length of each of the two foldable parts 11313 of the first movable part 1131 may be equal to or substantially equal to a length of each of the two foldable parts 11333 of the second movable part 1133. The manner for controlling the rotation of the first movable part 1131 and the second movable part 1133 may be similar to a manner that is used to control the rotation of the first movable part 1131 and the second movable part 1133 with respect to the fixed part 132 as described in FIG. 5, which is not repeated herein.

In some embodiments, as shown in FIG. 11A, when the foldable horizontal bar 1100 is in the folded state, the first movable part 1131 and the second movable part 1133 may be folded, and a part 11313 of the first movable part 1131 that is close to the fixed part 1132 and a part of the second movable part 1133 that is close to the fixed part 1132 may contact the support 1120 and form a triangle shape with the fixed part 1132. The top angle of the triangle shape may be in a range of [60°, 90° ]. In some embodiments, the two parts 11313 or the two parts 11333 may form an angle (denoted by β). The angle of β may be in a range from 0 degrees to 180 degrees (i.e., ∠β=[0°, 180°]). For example, when the foldable horizontal bar 1100 is in the folded state as shown in FIG. 11 A, the angle of β may be equal to or close to 0 degree, that is, the two parts 11313 or the two parts 11333 may be completely folded. As another example, when the foldable horizontal bar 1100 is in the unfolded state (not shown), the angle of β may be equal to 180 degrees, that is, the two parts 11313 or the two parts 11333 may be completely unfolded. When the foldable horizontal bar 1100 is in a partially-folded state as shown in FIG. 11B, the angle of β may be greater than 0 degree and less than 180 degrees, that is, the two parts 11313 or the two parts 11333 may be partially-folded. In some embodiments, an occupied area of the foldable horizontal bar 1100 in the folded state may be less than an occupied area of the foldable horizontal bar 1100 in the unfolded state or the partial-folded state. When the foldable horizontal bar 1100 is in the folded state, the occupied area of the foldable horizontal bar 100 may be the minimum, which is easy to be stored.

It should be noted that the descriptions of the foldable parts of the first movable part 1131 or the second movable part 1133 are merely provided for the purposes of illustration, and not intended to limit the scope of the present disclosure. For persons having ordinary skills in the art, multiple variations and modifications may be made under the teachings of the present disclosure. However, those variations and modifications do not depart from the scope of the present disclosure. In some embodiments, the ratio of lengths of the two foldable parts 11313 of the first movable part 1131 or the ratio of lengths of the two foldable parts 11333 of the second movable part 133 may be 2:1, 3:1, etc., which is not limited herein. In some embodiments, the first movable part 1131 and/or the second movable part 1133 may include more than two parts, which may not be limited in the present disclosure.

Figure 12:
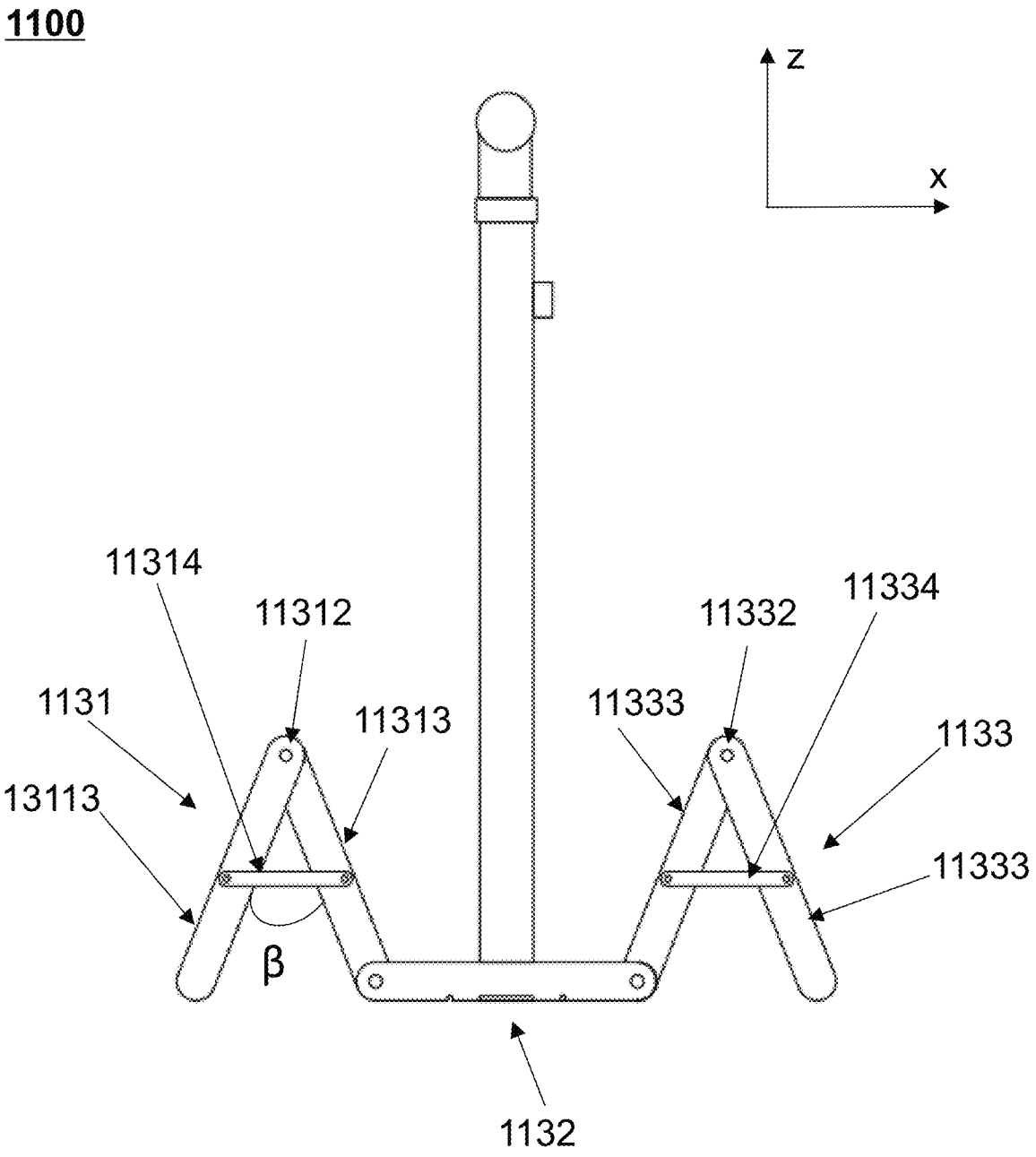
FIG. 12 is another schematic diagram illustrating an exemplary foldable horizontal bar in a partially-folded state according to some embodiments of the present disclosure.

FIG. 12 is a schematic diagram illustrating an exemplary foldable horizontal bar in a partially-folded state according to some embodiments of the present disclosure.

As described in connection with FIGS. 11A and 11B, when two foldable parts 11313 of the first movable part 1131 and two foldable parts 11333 of the second movable part 1133 are partially-folded, the foldable horizontal bar 1100 may be in the partially-folded state.

In some embodiments, a connection rod 11314 may be arranged between the two foldable parts 11313 of the first movable part 1131, and a connection rod 11334 may be arranged between the two foldable parts 11333 of the second movable part 1133. The connection rod 11314 may be configured to fix the two parts 11313 of the first movable part 1131, and the connection 11334 may be configured to fix the two parts 11333 of the second movable part 1133. In some embodiments, the connection rod 11314 or the connection rod 11334 may be with fixed length and movable along a direction parallel to the z-axis according to different folded situations of the first movable part 1131 or the second movable part 1133. For example, when the foldable horizontal bar 1100 is in the partially-folded state, the connection rod 11314 or the connection 11334 may move upwards with respect to the foldable parts 11313 as the angle of β increases. In some embodiments, the position of the connection rod 11314 or the connection 11334 may be fixed, and the connection rod 11314 or the connection rod 11334 may be elastic and flexible, and their lengths along a direction parallel to the x-axis may be adjustable.

By using the connection rod 11314 and/or the connection rod 11334, the stability of the foldable horizontal bar 1100 in the partially-folded state may be improved. In some embodiments, an occupied area of the foldable horizontal bar 1100 in the partially-folded state (e.g., as illustrated in FIG. 11B and FIG. 12) may be less than an occupied area of the foldable horizontal bar 1100 in the unfolded state. In addition, the stability of the foldable horizontal bar 1100 in the partially-folded state may be higher than the stability of the foldable horizontal bar 1100 in the folded state (e.g., as illustrated in FIG. 11A). That is, the foldable horizontal bar 1100 in the partially-folded state may be suitable for more application scenarios that is in small space and needs a high stability, thereby improving the safety of using the foldable horizontal bar 1100 in a small space.

Figure 13:
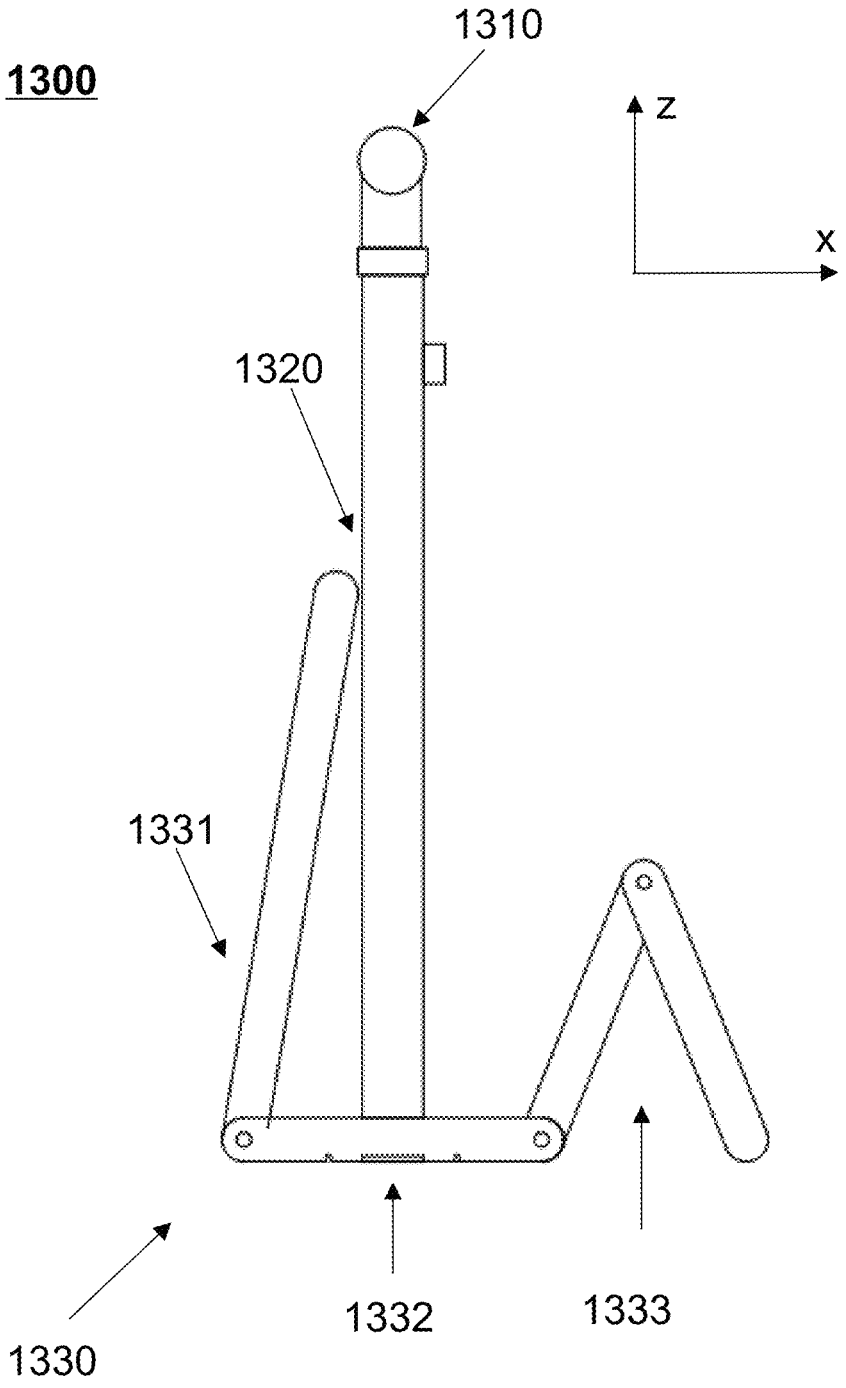
FIG. 13 is another schematic diagram illustrating an exemplary foldable horizontal bar in a folded state according to some embodiments of the present disclosure.

FIG. 13 is a schematic diagram illustrating an exemplary foldable horizontal bar in a folded state according to some embodiments of the present disclosure. The foldable horizontal bar 1300 may include a horizontal bar 1310, a pair of supports 1320, and a pair of bases 1330. The horizontal bar 1110 may be similar to or the same as the horizontal bar 110 of the foldable horizontal bar 100. The pair of supports 1120 may be similar to or the same as the pair of supports 120. The pair of bases 1330 may be similar to the pair of bases 130 of the foldable horizontal bar 100, except for the movable parts of the pair of bases 1130 are different from those of the pair of bases 130. For example, each base 1330 may include a first movable part 1331, a fixed part 1332, and a second movable part 1333. The first movable part 1331 and the fixed part 1332 may be similar to or the same as the first movable part 131 and the fixed part 132 of the foldable horizontal bar 100, respectively. The second movable part 1333 may be similar to the second movable part 1133 of the foldable horizontal bar 1100.

In some embodiments, when the first movable part 1331 is folded and the second movable part 133 is unfolded/folded, the first movable part 1331, the second movable part 133, and the fixed part 1332 may form an unsymmetrical structure. In some embodiments, when the first movable part 1331 is unfolded and the second movable part 1333 is folded or partially-folded, the first movable part 1331, the second movable part 133, and the fixed part 1332 may also form an unsymmetrical structure. When the first movable part 1331, the second movable part 133, and the fixed part 1332 form an unsymmetrical structure, the foldable horizontal bar 1300 may be suitable for different application scenarios. For example, when the foldable horizontal bar 1300 needs to be used in a position near a wall, and there is not enough space to completely unfold the first movable part 1331 and the second movable part 1333 at the same time. Thus, the first movable part 1331, which is near the wall, may be folded, and the second movable part 1333 may be unfolded or partially-folded to improve the stability of the foldable horizontal bar 1300. Thus, the foldable horizontal bar 1300 may be used without occupying a large space, and keep the high stability at the same time, and the practicability of the foldable horizontal bar 1300 may be improved.

Figure 14:
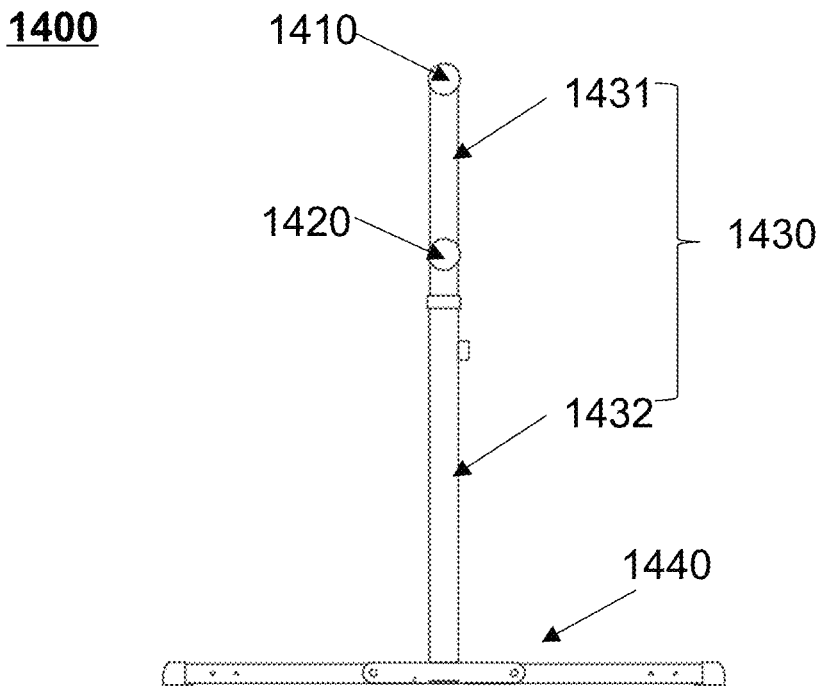
FIG. 14 is aa schematic diagram illustrating an exemplary foldable horizontal bar in an unfolded state according to some embodiments of the present disclosure.

FIG. 14 is a schematic diagram illustrating an exemplary foldable horizontal bar in an unfolded state according to some embodiments of the present disclosure. The foldable horizontal bar 1400 may be similar to the foldable horizontal bar 100, except that the foldable horizontal bar 1400 may include an additional horizontal bar.

As shown in FIG. 14, the foldable horizontal bar 1400 may include horizontal bars 1410 and 1420, a pair of supports 1430, and a pair of bases 1440. The horizontal bar 1410 may be similar to or the same as the horizontal bar 110 of the foldable horizontal bar 100. The pair of bases 1440 may be the same as or similar to the pair of bases 130 of the foldable horizontal bar 100. Each support 1430 may include a sliding supporting part 1431 and a fixed supporting part 1432. The fixed supporting part 1432 may be similar to or the same as the fixed supporting part 122 of the foldable horizontal bar 100. The sliding supporting part 1431 may be similar to the sliding supporting part 121 of the foldable horizontal bar 100, except that the sliding supporting part 1431 needs to support two horizontal bars. The horizontal bar 1420 may be similar to the horizontal bar 110 of the foldable horizontal bar 100, and a connection between the horizontal bar 1420 and the sliding supporting parts 1431 may be similar to the connection between the horizontal bar 110 and the sliding supporting parts 121 of the foldable horizontal bar 110, which is not repeated herein.

Figure 15:
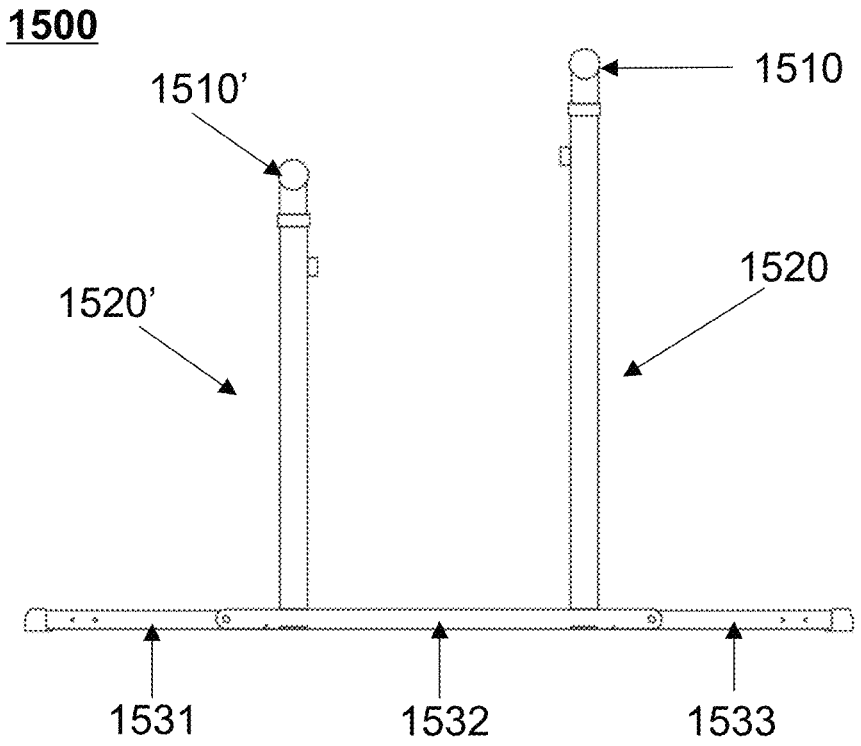
FIG. 15 is a schematic diagram illustrating exemplary uneven bars in an unfolded state according to some embodiments of the present disclosure.

FIG. 15 is a schematic diagram illustrating exemplary uneven bars according to some embodiments of the present disclosure. As shown in FIG. 15, the uneven bars 1500 may include a horizontal bar 1510 (or referred to as a first horizontal bar), a horizontal bar 1510' (or referred to as a second horizontal bar), a pair of supports 1520 (or referred to as a first pair of supports), a pair of supports 1520' (or referred to as a second pair of supports), and a pair of bases each including a first movable part 1531, a fixed part 1532, and a second movable part 1533. The horizontal bar 1510 and the horizontal bar 1510' may have different distances to the pair of bases (i.e., have heights). For example, a height of a fixed supporting part of the support 1520 may be different from a height of a fixed supporting part of the support 1520'. The pair of supports 1520 and the pair of supports 1520' may be configured to support the horizontal bars 1510 and 1510', respectively. In some embodiments, each of the horizontal bars 1510 and 1510' may be similar to the horizontal bar 110 of the foldable horizontal bar 100. Each of the pair of supports 1520 and the pair of supports 1520' may be similar to the pair of supports 120 of the foldable horizontal bar 100. The first movable part 1531 may be similar to the first movable part 131 of the foldable horizontal bar 100. The second movable part 1533 may be similar to the second movable part 133 of the foldable horizontal bar 100. The fixed part 1532 may be similar to the fixed part 132 of the foldable horizontal bar 100, except that the fixed part 1532 is connected with two supports (i.e., the supports 1520 and 1520'). That is, the fixed part 1532 may be mechanically connected with the first movable part 1531 and the second movable part 1532. In some embodiments, the first movable part 1531 may be rotatable around a first connection point between the fixed part 1532 and the first movable part 1531 within a preset angle. Similarly, the second movable part 1533 may be rotatable around a second connection point between the fixed part 1531 and the second movable part 1533 within the preset angle. Thus, the uneven bars 1500 may change between an unfolded state and a folded state when the first movable part 1531 and the second movable part 1533 rotate around the first connection point and the second connection point. In some embodiments, the preset angle may be larger than 90 degrees (e.g., 120 degrees). Accordingly, the uneven bars 1500 may also be a foldable uneven bars that can be used in different application scenarios.

It should be noted that the descriptions of the uneven bars 1500 are merely provided for the purposes of illustration, and not intended to limit the scope of the present disclosure. For persons having ordinary skills in the art, multiple variations and modifications may be made under the teachings of the present disclosure. However, those variations and modifications do not depart from the scope of the present disclosure. In some embodiments, the fixed support 1532 may be manufactured by integrated modeling. Alternatively, the fixed support 1532 may include two parts connected in a detachable manner, e.g., using a mortise and tenon structure.

Figure 16A:
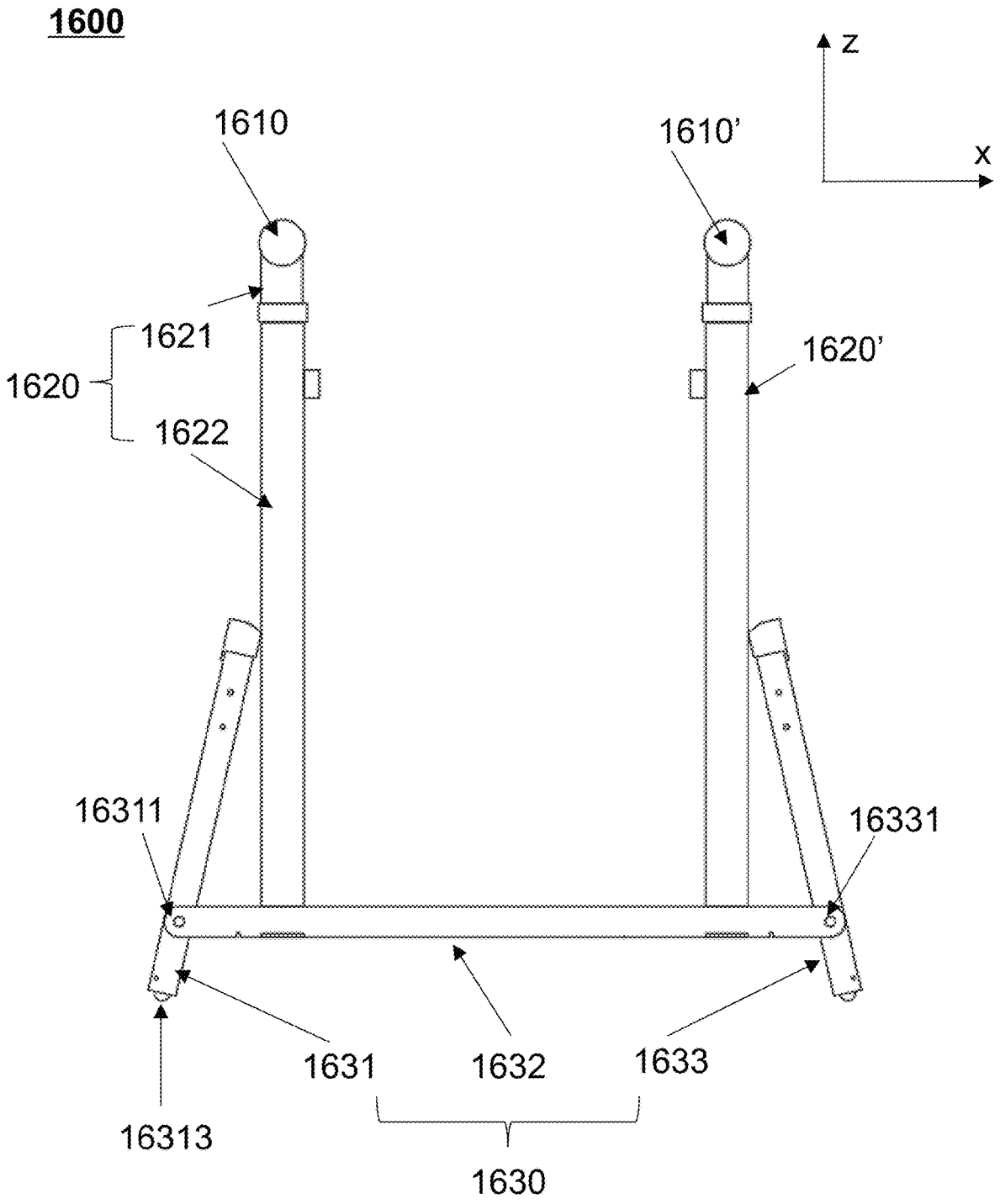
FIG. 16A is a schematic diagram illustrating exemplary parallel bars in a folded state according to some embodiments of the present disclosure.
Figure 16B:
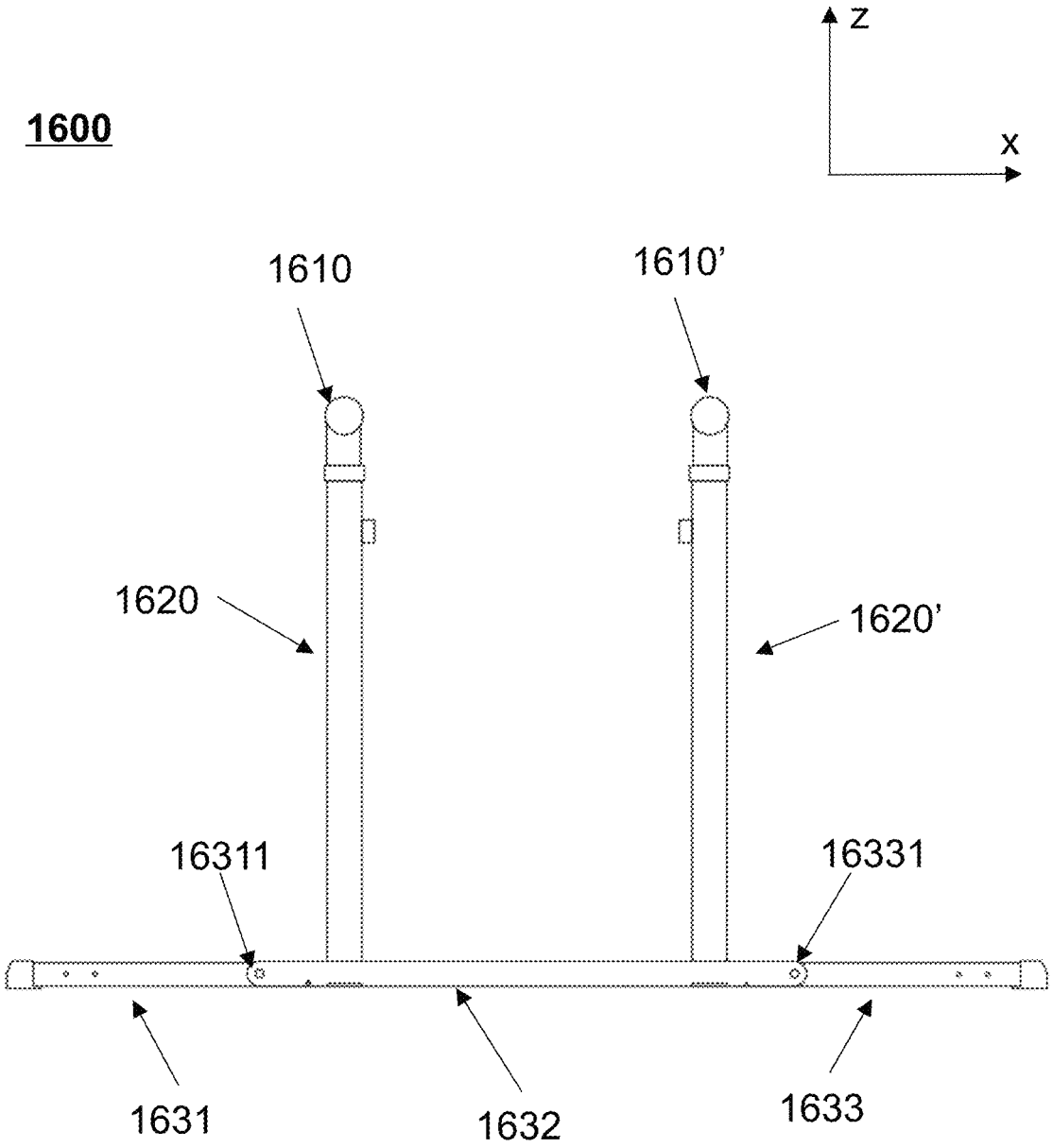
FIG. 16B is a schematic diagram illustrating exemplary parallel bars in an unfolded state according to some embodiments of the present disclosure.

FIG. 16A is a schematic diagram illustrating exemplary parallel bars in a folded state according to some embodiments of the present disclosure. FIG. 16B is a schematic diagram illustrating exemplary parallel bars in an unfolded state according to some embodiments of the present disclosure. As shown in FIGS. 16A and 16 B, the parallel bars 1600 may include a first horizontal bar 1610 and a second horizontal bar 1610' that share a pair of bases 1630. Each base 1630 may include a first movable part 1631, a second movable part 1633, and a fixed part 1632. The distance between the first horizontal bar 1610 and the pair of bases is the same as a distance between the second horizontal bar 1610' and the pair of bases, that is, the first horizontal bar 1610 and the second horizontal bar 1610' have the same height. The parallel bars 1600 may include a pair of supports 1620 for supporting the first horizontal bar 1610, and a pair of supports 1620' for supporting the second horizontal bar 1610'. The two pairs of supports 1620 and 1620' may be fixed on the fixed parts 1632 of the pair of bases 1630. The fixed part 1632 may be mechanically connected with the first movable part 1631 and the second movable part 1633. For example, the first movable part 1631 may be rotatable around a first connection point 16311 between the fixed part 1632 and the first movable part 1631 within a preset angle, and the second movable part 1633 may be rotatable around a second connection point 16331 between the fixed part 1632 and the second movable part 1633 within the preset angle. In some embodiments, the preset angle may be larger than 90 degrees (e.g., 120 degrees). Thus, the parallel bars 1600 may change between an unfolded state and a folded state when the first movable part 1631 and the second movable part 1633 rotate around the first connection point 16311 and the second connection point 16331. Accordingly, the parallel bars 1600 may be a foldable parallel bars that can be used in different application scenarios.

Figure 17:
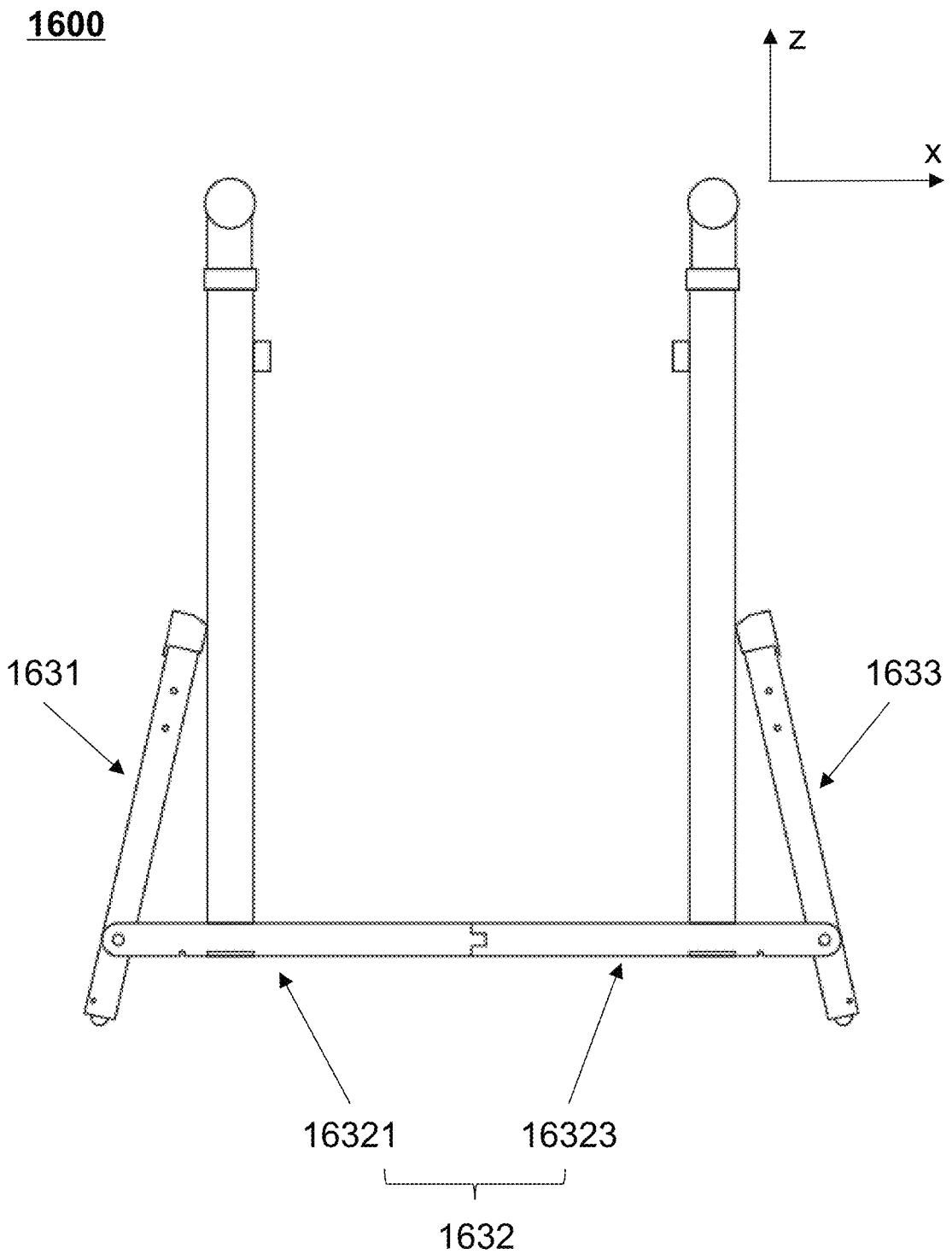
FIG. 17 is another schematic diagram illustrating exemplary parallel bars in an unfolded state according to some embodiments of the present disclosure.

In some embodiments, the fixed part 1632 may be manufactured by integrated modeling, e.g., as shown in FIGS. 16A and 16B. Alternatively, fixed part 1632 may include two sub-parts 16321 and 16323 detachably connected with each other, e.g., as shown in FIG. 17. For example, the two sub-parts 16321 and 16323 may be connected with each other by a mortise and tenon structure.

Figure 18:
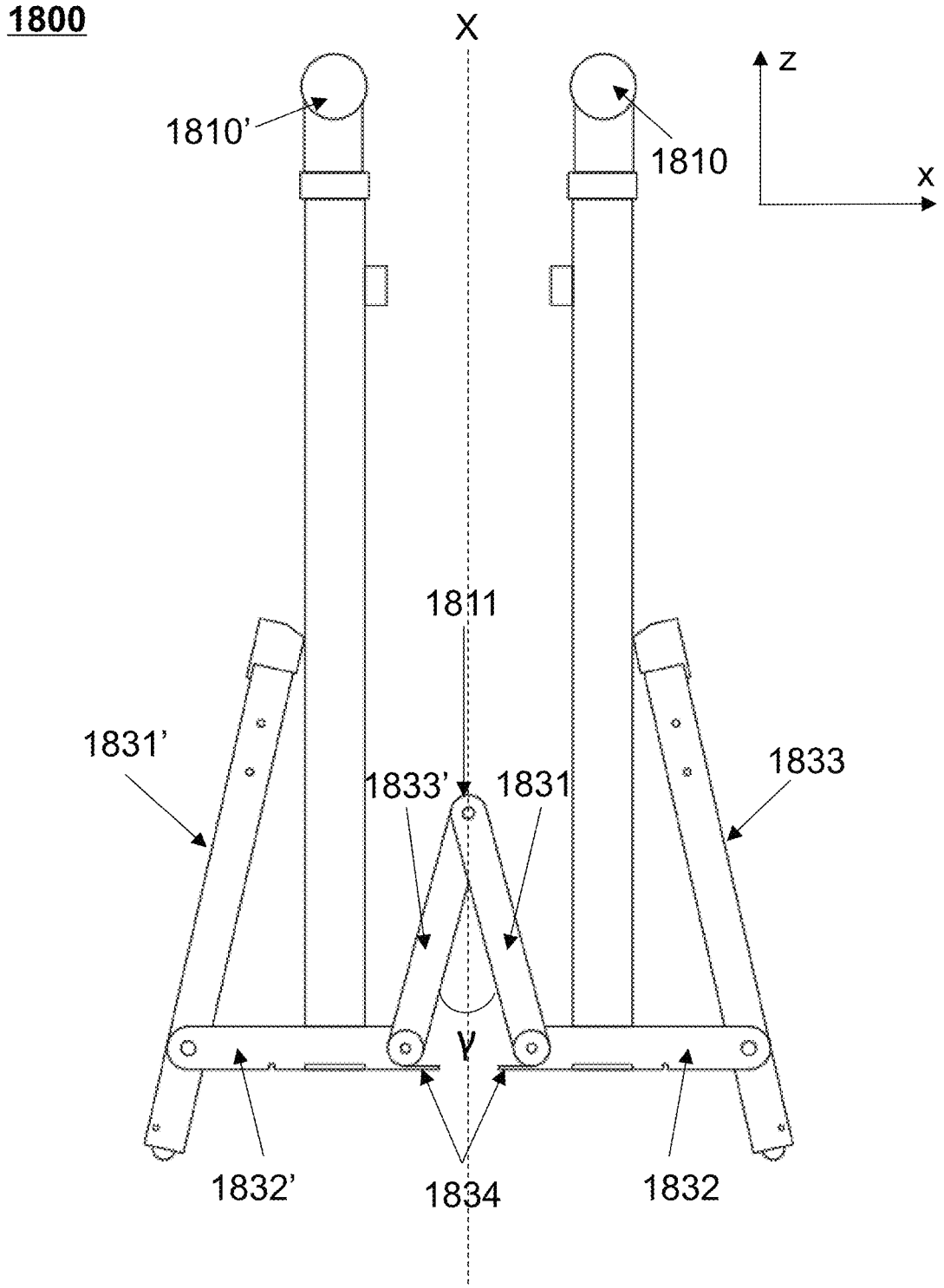
FIG. 18 is a schematic diagram illustrating exemplary parallel bars in a folded state according to some embodiments of the present disclosure.

FIG. 18 is a schematic diagram illustrating exemplary parallel bars in a folded state according to some embodiments of the present disclosure.

In some embodiments, the parallel bars 1800 may be similar to the parallel bars 1600, except that a first horizontal bar 1810 and a second horizontal bar 1810' of the parallel bars 1800 do not share the same fixed part. As shown in FIG. 18, a base of the parallel bars 1800 may include a first part corresponding to the first horizontal bar 1810 and a second part corresponding to the second horizontal bar 1810'. The first part may include a first movable part 1831, a fixed part 1832, and a second movable part 1833. The second part may include a first movable parts 1831', a fixed part 1832', and a second movable part 1833'. The second movable part 1833' and a first movable part 1831 may be rotatable and connected with each other at a connection point 1811. The second movable part 1833' and the first movable part 1831 may rotate around the connection point 1811, such that the parallel bars 1800 can be further folded in comparison with the parallel bars 1600. For example, when the parallel bars 1800 are in the folded state as illustrated in FIG. 18, the second foldable part 1833' and the first foldable part 1831 may form an angle (denoted by $\gamma$). When the parallel bars 1800 are in an unfolded state, the angle $\gamma$ may be equal to 180 degrees. When the parallel bars 1800 is in a partially-folded state, the angle $\gamma$ may be greater than 0 degree and less than 180 degrees. When the parallel bars 1800 is in a completely-folded state, the angle $\gamma$ may be equal to or close to 0 degree.

In some embodiments, two baffles 1834 may be arranged on the bottom surface of each of the fixed parts 1832 and 1832' and protrude to a center line X of the parallel bars, as shown in FIG. 18. The baffles 1834 may be configured to limit a position of the foldable parts 1832 and 1832' when the parallel bars are in the unfolded state. That is, the baffles 1834 may prevent the angle $\gamma$ from exceeding 180 degrees, thus avoiding deformation of the parallel bars 1800.

It should be noted that the descriptions of the parallel bars 1800 are merely provided for the purposes of illustration, and not intended to limit the scope of the present disclosure. For persons having ordinary skills in the art, multiple variations and modifications may be made under the teachings of the present disclosure. However, those variations and modifications do not depart from the scope of the present disclosure.

Having thus described the basic concepts, it may be rather apparent to those skilled in the art after reading this detailed disclosure that the foregoing detailed disclosure is intended to be presented by way of example only and is not limiting. Various alterations, improvements, and modifications may occur and are intended for those skilled in the art, though not expressly stated herein. These alterations, improvements, and modifications are intended to be suggested by this disclosure, and are within the spirit and scope of the exemplary embodiments of this disclosure.

Certain terminology has been used to describe embodiments of the present disclosure. For example, the terms "one embodiment," "an embodiment," and/or "some embodiments" mean that a particular feature, structure, or characteristic described in connection with the embodiment is included in at least one embodiment of the present disclosure. Therefore, it is emphasized and should be appreciated that two or more references to "an embodiment" or "one embodiment" or "an alternative embodiment" in various portions of this disclosure are not necessarily all referring to the same embodiment. Furthermore, the particular features, structures, or characteristics may be combined as suitable in one or more embodiments of the present disclosure.

It should be appreciated that in the foregoing description of embodiments of the present disclosure, various features are sometimes grouped together in a single embodiment, figure, or description thereof for the purpose of streamlining the disclosure aiding in the understanding of one or more of the various inventive embodiments. This method of disclosure, however, is not to be interpreted as reflecting an intention that the claimed subject matter requires more features than are expressly recited in each claim. Rather, inventive embodiments lie in less than all features of a single foregoing disclosed embodiment.

In some embodiments, the numbers expressing quantities or properties used to describe and claim certain embodiments of the application are to be understood as being modified in some instances by the term "about," "approximate," or "substantially." For example, "about," "approximate," or "substantially" may indicate ±20% variation of the value it describes, unless otherwise stated. Accordingly, in some embodiments, the numerical parameters set forth in the written description and attached claims are approximations that may vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the application are approximations, the numerical values set forth in the specific examples are reported as precisely as practicable.

Each of the patents, patent applications, publications of patent applications, and other material, such as articles, books, specifications, publications, documents, things, and/or the like, referenced herein is hereby incorporated herein by this reference in its entirety for all purposes, excepting any prosecution file history associated with same, any of same that is inconsistent with or in conflict with the present document, or any of same that may have a limiting effect as to the broadest scope of the claims now or later associated with the present document. By way of example, should there be any inconsistency or conflict between the description, definition, and/or the use of a term associated with any of the incorporated material and that associated with the present document, the description, definition, and/or the use of the term in the present document shall prevail.

In closing, it is to be understood that the embodiments of the application disclosed herein are illustrative of the principles of the embodiments of the application. Other modifications that may be employed may be within the scope of the application. Thus, by way of example, but not of limitation, alternative configurations of the embodiments of the application may be utilized in accordance with the teachings herein. Accordingly, embodiments of the present application are not limited to that precisely as shown and described.

What is claimed is:

1. A foldable horizontal bar, comprising:

a horizontal bar;

a pair of supports configured to support the horizontal bar; and a pair of bases, each base includes a first movable part, a second movable part, and a fixed part, wherein;

the fixed part is mechanically connected with the first movable part and the second movable part;

the first movable part is rotatable around a first connection point between the fixed part and the first movable part within a preset angle;

the second movable part is rotatable around a second connection point between the fixed part and the second movable part within the preset angle, the preset angle being larger than 90 degrees;

the foldable horizontal bar changes between an unfolded state and a folded state when the first movable part and the second movable part rotate around the first connection point and the second connection point, the first movable part, the second movable part, and the fixed part form a triangle shape when the foldable horizontal bar is in the folded state, and a top angle of the triangle shape is in a range from 60 degrees to 90 degrees.

2. The foldable horizontal bar of claim 1, wherein the fixed part includes an accommodation slot for accommodating a first portion of the first movable part and a second portion of the second movable part when the foldable horizontal bar is in the unfolded state, the first portion is a portion between the first connection position and a first end of the first movable part that is closer to the fixed part, and the second portion is a portion between the second connection position and a second end of the second movable part that is closer to the fixed part.

3. The foldable horizontal bar of claim 2, wherein the first movable part includes a first bulge near the first end of the first movable part, the second movable part includes a second bulge near the second end of the second movable part, the fixed part includes a first position limiting slot for limiting the first bulge and a second position limiting slot for limiting the second bulge when the foldable horizontal bar is in the unfolded state.

4. The foldable horizontal bar of claim 3, wherein when the foldable horizontal bar is in the unfolded state, the first position limiting slot is buckled on the first bulge and the second position limiting slot is buckled on the second bulge.

5. The foldable horizontal bar of claim 2, wherein a length of the first portion of the first movable part is equal to a length of the second portion of the second movable part.

6. The foldable horizontal bar of claim 5, wherein the length of the first portion of the first movable part is equal to or shorter than a length of a rest portion of the first movable part; and/or the length of the second portion of the second movable part is equal to or shorter than a length of a rest portion of the second movable part.

7. The foldable horizontal bar of claim 5, wherein balance components are provided on the first movable part and the second movable part, respectively, and the balance components include at least one of a cushion block or a pad.

8. The foldable horizontal bar of claim 1, wherein the foldable horizontal bar includes a first length along an extension direction of the horizontal bar and a second length along an extension direction of the fixed part, the extension direction of the fixed part being a direction along an x-axis of a normal axis, when the foldable horizontal bar is in the unfolded state, a ratio of the first length to the second length is substantially equal to 1:1.

9. The foldable horizontal bar of claim 8, wherein when the foldable horizontal bar is in the folded state, the ratio of the first length to the second length is substantially equal to 4:1.

10. The foldable horizontal bar of claim 1, wherein the first movable part and the second movable part are foldable, when the first movable part and the second movable part are folded, the foldable horizontal bar is in a partially-folded state, and the top angle of the triangle shape is greater than 60 degrees and less than 90 degrees.

11. The foldable horizontal bar of claim 10, wherein an occupied area of the foldable horizontal bar in the folded state is less than an occupied area of the foldable horizontal bar in the unfolded state and an occupied area of the foldable horizontal bar in the partially-folded state.

12. The foldable horizontal bar of claim 1, wherein the foldable horizontal bar further includes:

a first rod that is detachably connected with the first movable parts of the pair of bases; and a second rod that is detachably connected with the second movable parts of the pair of bases.

13. The foldable horizontal bar of claim 12, wherein the first rod is movable with respect to the first movable parts of the pair of bases; and/or the second rod is movable with respect to the second movable parts of the pair of bases.

14. The foldable horizontal bar of claim 1, wherein each of the first movable part and the second movable part includes a top surface and a bottom surface, a first area of the top surface being less than or equal to a second surface of the bottom surface.

15. The foldable horizontal bar of claim 1, wherein each support of the pair of supports includes a position limiting slot configured to fix the first movable part or the second movable part when the foldable horizontal bar is in the folded state.

16. The foldable horizontal bar of claim 1, wherein each support of the pair of supports includes a fixed supporting part and a sliding supporting part, the sliding supporting part being slidable with respect to the fixed supporting part such that a distance between the horizontal bar and the pair of bases is adjustable.

17. The foldable horizontal bar of claim 1, wherein each of the first movable part and the second movable part is made of a material with a first density, and the fixed part is made of a material with a second density greater than the first density.

18. The foldable horizontal bar of claim 1, further comprising a non-slip structure that is detachably mounted on the horizontal bar.

19. The foldable horizontal bar of claim 1, further comprising:

a first wheel detachably mounted on an end of each first movable part that is closer to the fixed part when the foldable horizontal bar is in the folded state;

a second wheel detachably mounted on an end of each second movable part that is closer to the fixed part when the foldable horizontal bar is in the folded state.

* * * * *